US009928781B2

(12) United States Patent
Kamiyamaguchi et al.

(10) Patent No.: US 9,928,781 B2
(45) Date of Patent: Mar. 27, 2018

(54) ORGANIC EL DISPLAY DEVICE AND DRIVING METHOD

(71) Applicant: JOLED INC., Tokyo (JP)

(72) Inventors: Jun Kamiyamaguchi, Tokyo (JP); Hiroshi Takahara, Osaka (JP)

(73) Assignee: JOLED INC., Tokyo (JP)

( * ) Notice: Subject to any disclaimer, the term of this patent is extended or adjusted under 35 U.S.C. 154(b) by 98 days.

(21) Appl. No.: 15/114,530

(22) PCT Filed: Dec. 22, 2014

(86) PCT No.: PCT/JP2014/006372
§ 371 (c)(1),
(2) Date: Jul. 27, 2016

(87) PCT Pub. No.: WO2015/111118
PCT Pub. Date: Jul. 30, 2015

(65) Prior Publication Data

US 2016/0343305 A1 Nov. 24, 2016

(30) Foreign Application Priority Data

Jan. 27, 2014 (JP) ..... 2014-012480

(51) Int. Cl.
*G09G 3/30* (2006.01)
*G09G 3/3291* (2016.01)
(Continued)

(52) U.S. Cl.
CPC ..... *G09G 3/3291* (2013.01); *G09G 3/3241* (2013.01); *G09G 3/204* (2013.01);
(Continued)

(58) Field of Classification Search
CPC ..... G09G 3/30–3/3291; G09G 2320/0404–2320/0495; G09G 2330/00–2330/12
See application file for complete search history.

(56) References Cited

U.S. PATENT DOCUMENTS 6,870,322 B1 * 3/2005 Mizukoshi ..... G09G 3/3216 315/169.1
7,046,220 B2 5/2006 Tagawa et al.
(Continued)

FOREIGN PATENT DOCUMENTS

JP 2003-150107 5/2003
JP 2003-330421 11/2003
(Continued)

OTHER PUBLICATIONS

International Search Report (ISR) from International Searching Authority (Japan Patent Office) in International Pat. Appl. No. PCT/JP2014/006372, dated Mar. 31, 2015.
(Continued)

*Primary Examiner* — Sanghyuk Park
(74) *Attorney, Agent, or Firm* — Greenblum & Bernstein, P.L.C.

(57) ABSTRACT

A plurality of display pixels each include: an organic EL element; a capacitance element that holds a first voltage used to cause the organic EL element to emit light; a drive transistor that supplies a current corresponding to the first voltage to the organic EL element; and a capacitance element that holds a second voltage that is a next voltage to be held in the capacitance element. A power line is connected to a drain electrode of the drive transistor or a cathode of the organic EL element. An adjustment unit adjusts the voltage applied to the power line to be lower than the predetermined voltage, when a total current of the plurality of display pixels in the case where a current corresponding to the second
(Continued)

voltage is supplied to the organic EL element in each of the plurality of display pixels is greater than or equal to a threshold.

9 Claims, 21 Drawing Sheets

(51) Int. Cl.
*G09G 3/3241* (2016.01)
*G09G 3/20* (2006.01)

(52) U.S. Cl.
CPC ..... *G09G 2300/0852* (2013.01); *G09G 2300/0861* (2013.01); *G09G 2300/0866* (2013.01); *G09G 2310/0262* (2013.01); *G09G 2320/043* (2013.01); *G09G 2320/045* (2013.01)

(56) References Cited

U.S. PATENT DOCUMENTS

| | | | |
|---|---|---|---|
| 7,375,711 | B2 | 5/2008 | Horiuchi et al. |
| 8,059,070 | B2 | 11/2011 | Odawara et al. |
| 8,902,132 | B2 | 12/2014 | Ozawa et al. |
| 8,922,541 | B2 | 12/2014 | Ono |
| 9,035,857 | B2 | 5/2015 | Kobayashi |
| 2003/0090446 | A1 | 5/2003 | Tagawa et al. |
| 2005/0057581 | A1 | 3/2005 | Horiuchi et al. |
| 2007/0139406 | A1 | 6/2007 | Ozawa et al. |
| 2010/0171733 | A1 | 7/2010 | Kobayashi |
| 2012/0320016 | A1 | 12/2012 | Hirata |
| 2012/0327108 | A1 | 12/2012 | Kato et al. |
| 2014/0152704 | A1* | 6/2014 | Jeong ..... G09G 3/3233 345/690 |

FOREIGN PATENT DOCUMENTS

| | | |
|---|---|---|
| JP | 2004-252216 | 9/2004 |
| JP | 2005-070426 | 3/2005 |
| JP | 2007-156045 | 6/2007 |
| JP | 2012-083728 | 4/2012 |
| WO | 2009/017156 | 2/2009 |
| WO | 2011/077718 | 6/2011 |
| WO | 2011/104965 | 9/2011 |

OTHER PUBLICATIONS

Office Action from Japan Patent Office (JPO) in Japanese Patent Appl. No. 2015-558617, dated Jul. 4, 2017.

* cited by examiner

ORGANIC EL DISPLAY DEVICE AND DRIVING METHOD

TECHNICAL FIELD

The present invention relates to an organic EL display device and a driving method, and particularly relates to a method of driving an organic EL display device that uses current-driven organic EL light emitting elements and the organic EL display device.

BACKGROUND ART

In an organic EL panel used in an organic EL display device, a larger current flows into the organic EL panel when screen luminance is higher. The flow of a larger current into the organic EL panel causes the organic EL panel to generate heat, which leads to shorter life of organic EL elements (light emitting elements). Overload control is therefore necessary. Moreover, since a heat dissipation mechanism is needed to cool the panel, a thinner panel cannot be realized.

For example, Patent Literature (PTL) 1 discloses a method of directly detecting power consumption from pixel data before actually displaying an image.

CITATION LIST

Patent Literature

[PTL 1]
Japanese Unexamined Patent Application Publication No. 2007-156045

SUMMARY OF INVENTION

Technical Problem

With the method disclosed in PTL 1, however, it is necessary to increase or decrease the gray level of input image data before actually displaying the image, or control the drive current in the image being displayed. In the case of increasing or decreasing the gray level of input image data before actually displaying the image, the operation is complex, and it takes time to display the image. In the case of controlling the drive current in the image being displayed, the luminance of the image being displayed changes, with which the viewer may feel uncomfortable.

The present invention has been made in view of the aforementioned problems, and has an object of providing an organic EL display device and a method of driving the organic EL display device that can prevent a decrease in life of light emitting elements.

Solution to Problem

To achieve the object stated above, an organic EL display device according to an aspect of the present invention includes: a plurality of display pixels arranged in a matrix; and an adjustment unit that adjusts a predetermined voltage applied to a power line connected to the plurality of display pixels, wherein each of the plurality of display pixels includes: a light emitting element; a first capacitance element that holds a first voltage used to cause the light emitting element to emit light; a drive transistor that causes the light emitting element to emit light, by supplying a current corresponding to the first voltage held in the first capacitance element to the light emitting element; and a second capacitance element that holds a second voltage different from the first voltage held in the first capacitance element, the second voltage being a next voltage to be held in the first capacitance element, the power line is connected to a drain electrode of the drive transistor or a cathode of the light emitting element, and the adjustment unit adjusts the voltage applied to the power line to be lower than the predetermined voltage, when a total sum of current of the plurality of display pixels in the case where a current corresponding to the second voltage is supplied to the light emitting element in each of the plurality of display pixels is greater than or equal to a threshold.

Advantageous Effects of Invention

The organic EL display device, etc. according to the present invention can prevent a decrease in life of light emitting elements.

DESCRIPTION OF EMBODIMENTS

Figure 1:
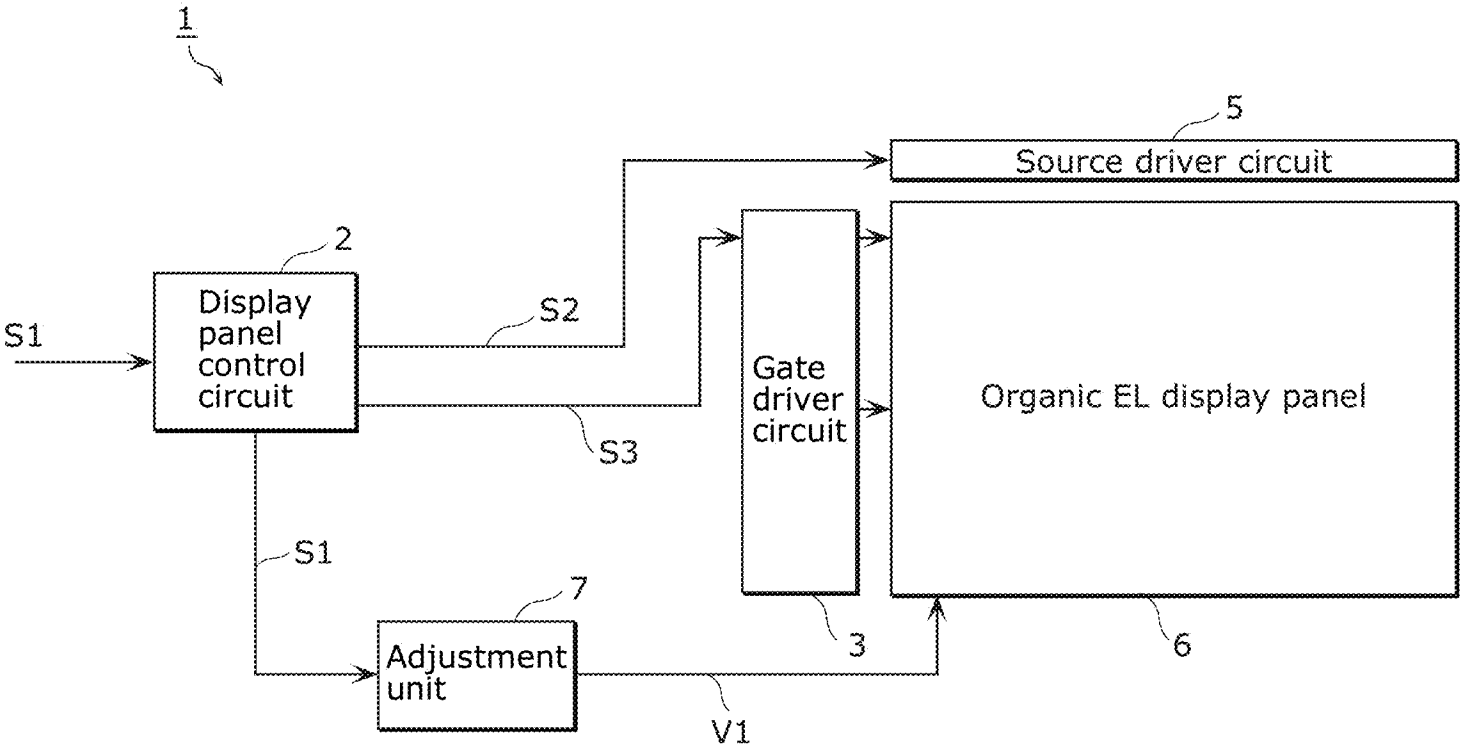
FIG. 1 is a block diagram illustrating an example of the structure of an organic EL display device according to Embodiment 1.

One aspect of an organic EL display device according to the present invention includes: a plurality of display pixels arranged in a matrix; and an adjustment unit that adjusts a predetermined voltage applied to a power line connected to the plurality of display pixels, wherein each of the plurality of display pixels includes: a light emitting element; a first capacitance element that holds a first voltage used to cause the light emitting element to emit light; a drive transistor that causes the light emitting element to emit light, by supplying a current corresponding to the first voltage held in the first capacitance element to the light emitting element; and a second capacitance element that holds a second voltage different from the first voltage held in the first capacitance element, the second voltage being a next voltage to be held in the first capacitance element, the power line is connected to a drain electrode of the drive transistor or a cathode of the light emitting element, and the adjustment unit adjusts the voltage applied to the power line to be lower than the predetermined voltage, when a total sum of current of the plurality of display pixels in the case where a current corresponding to the second voltage is supplied to the light emitting element in each of the plurality of display pixels is greater than or equal to a threshold.

With this structure, a decrease in life of light emitting elements can be prevented. In detail, the organic EL display device includes the adjustment unit, and is capable of writing a data signal voltage and displaying video independently of each other. This enables overload control so that the panel power due to the current flowing into the organic EL panel is less than a predetermined level, without lowering video quality. A decrease in life of the organic EL elements can thus be prevented.

For example, the organic EL display device may further include a control unit that controls each of the plurality of display pixels, wherein the control unit, in each of the plurality of display pixels: causes the second capacitance element to hold the second voltage, in a first period in a light emission period during which the light emitting element emits light; and copies the second voltage held in the second capacitance element to the first capacitance element to cause the first capacitance element to hold the second voltage as the first voltage, in a second period following an initialization period in a non-light emission period after the light emission period, the initialization period being a period during which the first capacitance element is initialized, and the adjustment unit adjusts the voltage applied to the power line to be lower than the predetermined voltage in the non-light emission period, when the total sum of current of the plurality of display pixels corresponding to the second voltage is greater than or equal to the threshold.

For example, the organic EL display device may display video by dividing one frame period of a video signal into a plurality of subframe periods, wherein a period between a light emission period during which the light emitting element emits light and a next light emitting period during which the light emitting element emits light corresponds to any of the plurality of subframe periods.

For example, the adjustment unit may adjust the voltage applied to the power line to be lower than the predetermined voltage by linearly changing the voltage for a predetermined time, when the total sum of current of the plurality of display pixels corresponding to the second voltage in the case where the current corresponding to the second voltage is supplied to the light emitting element in each of the plurality of display pixels is greater than or equal to the threshold.

For example, in the case where the drive transistor is p-type, the drive transistor may have the drain electrode connected to a first electrode of the first capacitance element, a gate electrode connected to a second electrode of the first capacitance element, and a source electrode connected to an anode of the light emitting element, and the power line may be connected to the cathode of the light emitting element.

For example, each of the plurality of display pixels may further include: a first switch that switches between conduction and nonconduction between a signal line for supplying a data signal voltage and a first electrode of the second capacitance element; a second switch that switches between conduction and nonconduction between the first electrode of the second capacitance element and the second electrode of the first capacitance element; a third switch that switches between conduction and nonconduction between a reference power line for supplying a reference voltage and the second electrode of the first capacitance element; and a fourth switch that switches between conduction and nonconduction between the source electrode of the drive transistor and the anode of the light emitting element, the reference power line may be connected to a second electrode of the second capacitance element, and the first switch, the second switch, the third switch, and the fourth switch may each be a p-type transistor.

For example, in the case where the drive transistor is n-type, the power line may be connected to the drain electrode of the drive transistor, and the drive transistor may have a source electrode connected to a first electrode of the first capacitance element and an anode of the light emitting element, and a gate electrode connected to a second electrode of the first capacitance element.

For example, each of the plurality of display pixels may further include: a first switch that switches between conduction and nonconduction between a signal line for supplying a data signal voltage and a first electrode of the second capacitance element; a second switch that switches between conduction and nonconduction between the first electrode of the second capacitance element and the second electrode of the first capacitance element; a third switch that switches between conduction and nonconduction between a reference power line for supplying a reference voltage and the second electrode of the first capacitance element; and a fourth switch that switches between conduction and nonconduction between the drain electrode of the drive transistor and the power line, the reference power line may be connected to a second electrode of the second capacitance element, and the first switch, the second switch, the third switch, and the fourth switch may each be an n-type transistor.

One aspect of a driving method according to the present invention is a method of driving an organic EL display device including: a plurality of display pixels arranged in a matrix; and a power line that is connected to the plurality of display elements and to which a predetermined voltage is applied, each of the plurality of display pixels including: a light emitting element; a first capacitance element that holds a first voltage used to cause the light emitting element to emit light; a drive transistor that causes the light emitting element to emit light, by supplying a current corresponding to the first voltage held in the first capacitance element to the light emitting element; and a second capacitance element that holds a second voltage different from the first voltage held in the first capacitance element, the second voltage being a next voltage to be held in the first capacitance element, the power line being connected to a drain electrode of the drive transistor or a cathode of the light emitting element, and the method including: adjusting the voltage applied to the power line to be lower than the predetermined voltage, when a total sum of current of the plurality of display pixels in the case where a current corresponding to the second voltage is supplied to the light emitting element in each of the plurality of display pixels is greater than or equal to a threshold; and causing the drive transistor to supply the current corresponding to the second voltage held in the first capacitance element to the light emitting element.

An organic EL display device and a method of driving the organic EL display device according to one aspect of the present invention are described in detail below, with reference to drawings.

Each of the embodiments described below shows a specific example of the present invention. The numerical values, shapes, materials, structural elements, the arrangement and connection of the structural elements, steps, the processing order of the steps, etc. shown in the following embodiments are mere examples, and do not limit the scope of the present invention. Of the structural elements in the embodiments described below, the structural elements not recited in any one of the independent claims representing the broadest concepts are described as optional structural elements. Note that each drawing is a schematic and does not necessarily provide precise depiction.

Embodiment 1

This embodiment describes the case of using organic EL elements as light emitting elements of an organic EL display device according to one aspect of the present disclosure.

1-1. Structure of Organic EL Display Device

FIG. 1 is a block diagram illustrating an example of the structure of an organic EL display device according to Embodiment 1.

An organic EL display device 1 illustrated in FIG. 1 includes a display panel control circuit 2, a gate driver IC (circuit) 3, a source driver IC (circuit) 5, an organic EL display panel 6, and an adjustment unit 7.

The organic EL display panel 6 at least includes N (e.g. N=1080) gate signal lines and N lighting control lines arranged in parallel with each other, and M source signal lines orthogonal to the N gate signal lines and N lighting control lines (not illustrated). The organic EL display panel 6 also includes pixel circuits each including thin-film transistors and an organic EL element, at the respective intersections of the source signal lines and gate signal lines (not illustrated).

In the organic EL display panel 6 according to this embodiment, EL elements of three primary colors of red (R), green (G), and blue (B) are arranged in a matrix.

Color filters of red (R), green (G), and blue (B) can be formed in correspondence with the pixel positions. The color filters are not limited to RGB, and pixels of cyan (C), magenta (M), and yellow (Y) may be formed. Pixels of white (W) may be formed, too. In this case, pixels of R, G, B, and W are arranged in a matrix on the display screen.

The pixel aperture ratio of each of R, G, and B may be different. When the aperture ratio is different, the density of current flowing through the light emitting element (the organic EL element 68) of each of R, G, and B is different. Such different current density allows the light emitting element of each of R, G, and B to have the same degradation speed. With the same degradation speed, the organic EL display panel 6 has no white balance deviation.

Pixels of white (W) are formed according to need. In this case, pixels of R, G, B, and W constitute the display screen. The RGBW composition contributes to higher luminance. The RGBG composition is also possible.

The organic EL display panel 6 is colorized by mask evaporation. This embodiment is, however, not limited to such. For example, a blue-light emitting EL layer may be formed, with the emitted blue light being converted into light of R, G, and B by color conversion layers of R, G, and B (color change media (CCM)).

A circularly polarizing plate (circularly polarizing film) (not illustrated) may be placed on the light emission surface of the organic EL display panel 6. The circularly polarizing plate (circularly polarizing film) is an integrated combination of a polarizing plate and a phase film.

The display panel control circuit 2 generates, based on a display data signal S1, a control signal S2 for controlling the source driver IC (circuit) 5, and outputs the generated control signal S2 to the source driver IC (circuit) 5. The display panel control circuit 2 also generates, based on a synchronization signal included in the display data signal S1, a control signal S3 for controlling the gate driver IC (circuit) 3, and outputs the generated control signal S3 to the gate driver IC (circuit) 3.

The display data signal S1 is a signal indicating display data, and includes a video signal, a vertical synchronization signal, and a horizontal synchronization signal. The video signal is a signal designating each pixel value as gray level information per frame. The vertical synchronization signal is a signal for synchronizing vertical processing on the screen, based on which per-frame processing is timed. The horizontal synchronization signal is a signal for synchronizing horizontal processing on the screen.

The control signal S2 includes the video signal and the horizontal synchronization signal. The control signal S3 includes the vertical synchronization signal and the horizontal synchronization signal.

The gate driver IC (circuit) 3 drives each gate signal line in the organic EL display panel 6, based on the control signal S3 generated by the display panel control circuit 2.

The source driver IC (circuit) 5 drives each source signal line in the organic EL display panel 6, based on the control signal S2 generated by the display panel control circuit 2. In more detail, the source driver IC (circuit) 5 outputs a source signal (data signal voltage) to each pixel circuit, based on the video signal and the horizontal synchronization signal.

The adjustment unit 7 adjusts a predetermined voltage applied to a power line (EL cathode power line) connected to the plurality of display pixels, based on the display data signal S1 received via the display panel control circuit 2. This will be described in detail later.

The organic EL display device 1 may include, for example, a central processing unit (CPU), a storage medium such as read only memory (ROM) storing a control program, working memory such as random access memory (RAM), and a communication circuit, although not illustrated. In this case, the display data signal S1 is generated, for example, by the CPU executing the control program.

Figure 2:
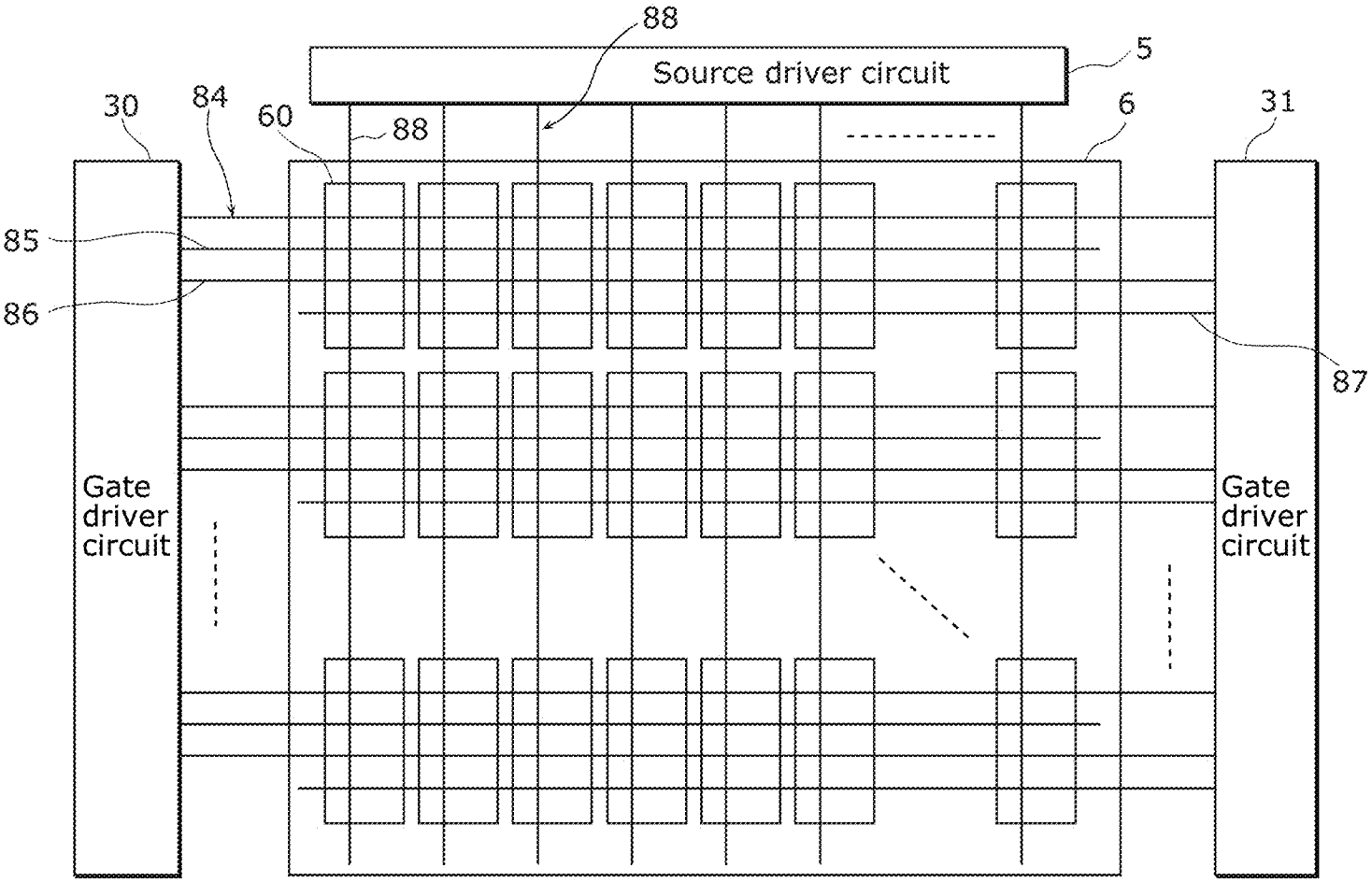
FIG. 2 is a diagram illustrating an example of the structure of an organic EL panel according to Embodiment 1.

FIG. 2 is a diagram illustrating an example of the structure of the organic EL display panel according to Embodiment 1. FIG. 2 illustrates the position and connection relationships between the organic EL display panel 6, the gate driver IC (circuit) 3, and the source driver IC (circuit) 5.

In this embodiment, the organic EL display panel 6 is connected with gate signal lines 84, 85, 86, and 87 controlled by a gate driver IC (circuit) 30 and a gate driver IC (circuit) 31.

The organic EL display panel 6 is also connected with source signal lines 88 controlled by the source driver IC (circuit) 5. The gate signal lines 84, 85, 86, and 87 and the source signal line 88 will be described later.

Although the gate driver IC (circuit) 3 is composed of the gate driver IC (circuit) 30 and gate driver IC (circuit) 31 which are respectively provided on the left and right of the organic EL display panel 6 in FIG. 2, this structure is merely an example. The gate driver IC (circuit) 3 may be provided on only one of the left and right of the organic EL display panel 6.

Although this embodiment assumes the circuit 5 as a source driver IC, the circuit is not limited to a source driver IC formed by a semiconductor chip. As an example, a silicon wafer is used to form transistors, which is peeled off and transferred onto a glass substrate. As another example, a silicon wafer is used to form a transistor chip, which is mounted on a glass substrate by bonding to form a display panel. Alternatively, a source driver circuit may be formed directly on a glass substrate on which pixels have been formed, using a technology such as low-temperature polysilicon, high-temperature polysilicon, or TAOS.

Although this embodiment assumes each of the circuits 30 and 31 as a gate driver IC, the circuit is not limited to a gate driver IC formed by a semiconductor chip. As an example, a silicon wafer is used to form transistors, which is peeled off and transferred onto a glass substrate. As another example, a silicon wafer is used to form a transistor chip, which is mounted on a glass substrate by bonding to form a display panel. Alternatively, a source driver circuit may be formed directly on a glass substrate on which pixels have been formed, using a technology such as low-temperature polysilicon, high-temperature polysilicon, or TAOS.

1-2. Circuit Structure of Display Pixel

Figure 3:
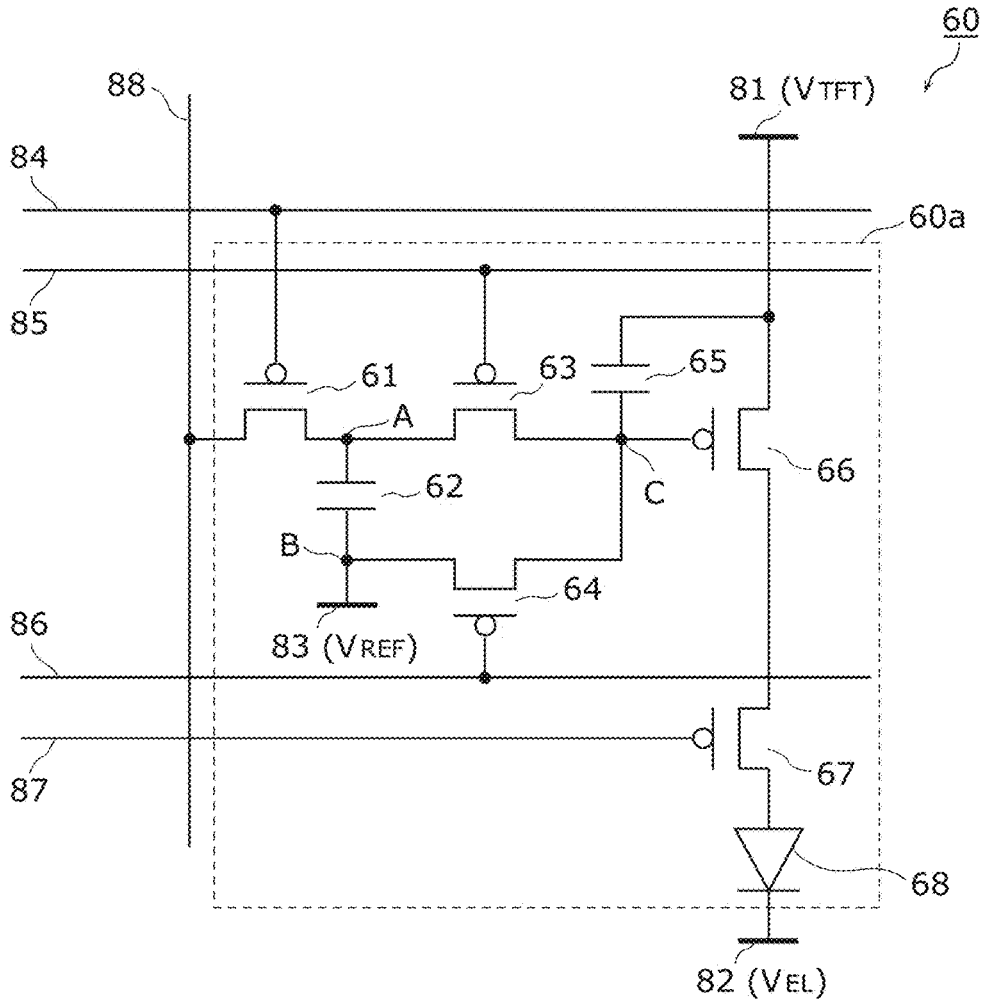
FIG. 3 is a diagram illustrating an example of the circuit structure of a display pixel according to Embodiment 1.

FIG. 3 is a diagram illustrating an example of the circuit structure of the display pixel according to Embodiment 1.

The display pixel according to Embodiment 1 includes transistors, capacitors, an EL element, etc. Although each of the transistors including drive transistors and switch transistors is described as a thin-film transistor (TFT) here, this is not a limitation. The transistor may be a FET, a MOSFET, a MOS transistor, a bipolar transistor, or the like. These are also basically thin-film transistors. Other examples include a varistor, a thyristor, a ring diode, a photodiode, a phototransistor, and a PLZT element.

The element is also not limited to a thin-film element, and may be a transistor formed in a silicon wafer. As an example, a silicon wafer is used to form transistors, which is peeled off and transferred onto a glass substrate. As another example, a silicon wafer is used to form a transistor chip, which is mounted on a glass substrate by bonding to form a display panel.

Both n-type and p-type transistors preferably use a lightly doped drain (LDD) structure.

Each transistor may be formed using any of high-temperature polycrystalline silicon (HTPS), low-temperature polysilicon (LTPS), continuous grain silicon (CGS), transparent amorphous oxide semiconductor (TAOS, IZO), amorphous silicon (AS), and infrared RTA (RTA: rapid thermal annealing).

Although all transistors in the display pixel are p-type in FIG. 3, this is not a limitation. All transistors may be n-type. Alternatively, both n-type and p-type transistors may be used.

Each switch transistor is not limited to a transistor, and may be, for example, an analog switch formed using both p-type and n-type transistors.

Each transistor preferably has a top-gate structure. With the top-gate structure, parasitic capacitance is reduced, and the gate electrode pattern of the top gate serves as a light shielding layer which shields light emitted from the EL element. This reduces transistor malfunctions and off-leakage current.

A process that can use copper wiring or copper alloy wiring as the wiring material of gate signal lines, source signal lines, or both gate signal lines and source signal lines is preferable. This reduces the wiring resistance of the signal lines, and makes it possible to realize a larger EL display panel.

Each gate signal line driven (controlled) by the gate driver IC (circuit) preferably has lower impedance. The same applies to the structure of the gate signal line.

The use of low-temperature polysilicon (LTPS) is particularly preferable. With low-temperature polysilicon, n-type and p-type transistors of a top-gate structure with low parasitic capacitance can be produced, and the copper wiring or copper alloy wiring process can be used as the process. The copper wiring preferably has a three-layer structure of Ti—Cu—Ti.

The wiring of gate signal lines, source signal lines, or the like preferably has a three-layer structure of Mo—Cu—Mo where Mo is molybdenum, in the case where the transistors are TAOS (transparent amorphous oxide semiconductor).

Each capacitor is formed or placed so as to overlap at least one of a source signal line and a gate signal line. This increases the freedom of layout, and secures a wider space between elements. Yields are thus enhanced.

An insulation film or an insulation film (planarizing film) made of an acrylic material is formed on each source signal line and gate signal line to ensure insulation, and a pixel electrode is formed on the insulation film.

A pixel circuit 60 illustrated in FIG. 3 is one pixel included in the organic EL display panel 6, and has a function of emitting light according to a source signal (video signal voltage) supplied via a source signal line 88.

The pixel circuit 60 is an example of one of the display pixels (light emitting pixels) arranged in a matrix. For example, as illustrated in FIG. 3, the pixel circuit 60 includes a switch 61, a capacitance element 62, a switch 63, a switch 64, a capacitance element 65, a drive transistor 66, a switch 67, and an organic EL element 68. The pixel circuit 60 also includes an EL anode power line 81 ($V_{TFT}$), an EL cathode power line 82 ($V_{EL}$), a reference power line 83 ($V_{REF}$), a gate signal line 84, a gate signal line 85, a gate signal line 86, a gate signal line 87, and a source signal line 88.

The source signal line 88 is an example of a signal line (source signal line) for supplying a data signal voltage (source signal).

The EL anode power line 81 ($V_{TFT}$) is a high-voltage power line, connected to the drain electrode of the drive transistor, for determining the potential of the drain electrode of the drive transistor 66. For example, the EL anode power line 81 ($V_{TFT}$) is 6 V.

The EL cathode power line 82 ($V_{EL}$) is a low-voltage power line connected to the cathode (second electrode) of the organic EL element 68.

The reference power line 83 ($V_{REF}$) is an example of a power line for supplying a reference voltage, and supplies a reference voltage $V_{REF}$. The potential difference between the reference voltage $V_{REF}$ supplied by the reference power line 83 ($V_{REF}$) and the anode voltage $V_{TFT}$ supplied by the EL anode power line 81 ($V_{TFT}$) is set to a voltage greater than the threshold voltage (Vth) of the drive transistor 66, that is, "(threshold voltage Vth)<(anode voltage $V_{TFT}$)−(reference voltage $V_{REF}$)". For example, the reference voltage $V_{REF}$ is 0 V in this embodiment.

The organic EL element 68 is an example of a light emitting element that emits light according to a current supplied from the drive transistor 66. A plurality of light emitting elements are arranged in a matrix. The organic EL element 68 has a cathode (second electrode) connected to the EL cathode power line 82, and an anode (first electrode) connected to the source (source electrode) of the drive transistor 66 via the switch 67. The voltage supplied to the EL cathode power line 82 is $V_{EL}$, which is −6 V as an example.

The drive transistor 66 is a voltage-driven drive element that controls the supply of current to the organic EL element 68, and causes the organic EL element 68 to emit light by supplying the current corresponding to the voltage held in the capacitance element 65 to the organic EL element 68. In more detail, the drive transistor 66 has a drain electrode conducting with a first electrode of the capacitance element 65, a gate electrode conducting with a second electrode of the capacitance element 65, and a source electrode connected to the anode of the organic EL element 68 via the switch 67, as illustrated in FIG. 3. For example, in a light emission period, the drive transistor 66 causes the organic EL element 68 to emit light by flowing the current corresponding to the voltage (data signal voltage) held in the display capacitance element 65 through the organic EL element 68. In more detail, the drive transistor 66 converts the data signal voltage supplied to the gate electrode into the current corresponding to the data signal voltage, and supplies the converted current to the organic EL element 68, to cause the organic EL element 68 to emit light. The light emission timing is controlled by the switch 67. In this embodiment, the switches 67 in all pixel circuits 60 (all pixels in the organic EL display panel 6) are collectively turned on (conduction), so that the organic EL elements 68 in all pixels are collectively lit. In other words, the light emission period begins simultaneously on the whole screen.

In a non-light emission period following the light emission period, for example, the switch 67 is turned off (nonconduction), and so the drive transistor 66 does not flow the current through the organic EL element 68. Thus, the drive transistor 66 does not cause the organic EL element 68 to emit light in the non-light emission period.

In this embodiment, the thin-film transistor (TFT) forming the drive transistor 66 is p-type.

Note that the thin-film transistor (TFT) forming the drive transistor 66 may be n-type, p-type, or a combination of n-type and p-type. Moreover, the channel layer of the thin-film transistor may be made of any of amorphous silicon, microcrystalline silicon, polysilicon, oxide semiconductor, organic semiconductor, etc. For example, the oxide semiconductor may be an oxide semiconductor material including at least one type selected from indium (In), gallium (Ga), and zinc (Zn). The oxide semiconductor has low off-current, has high electron mobility even in an amorphous state, and can be formed by a low-temperature process. For example, amorphous indium-gallium-zinc oxide (InGaZnO) may be used.

The capacitance element 65 is an example of a first capacitance element (display capacitor) for holding a first voltage used to cause the organic EL element 68 to emit light. The capacitance element 65 holds the voltage for determining the amount of current to be flown by the drive transistor 66. In detail, the first electrode (the electrode opposite to the node C) of the capacitance element 65 is connected between the drain electrode (the electrode on the EL anode power line 81 side) of the drive transistor 66 and the EL anode power line 81. The second electrode (the electrode on the node C side) of the capacitance element 65 is connected to the gate electrode of the drive transistor 66. The second electrode of the capacitance element 65 is connected to a first electrode (the electrode on the node A side) of the capacitance element 62 via the switch 63. The second electrode of the capacitance element 65 is connected to the reference power line 83 ($V_{REF}$) for supplying the reference voltage $V_{REF}$, via the switch 64.

In this embodiment, a second voltage held in the capacitance element 62 is copied to the capacitance element 65 which accordingly holds the second voltage as the first voltage under control of the display panel control circuit 2, in a second period following an initialization period for initializing the capacitance element 65 in the non-light emission period after the light emission period during which the organic EL element 68 emits light.

The capacitance element 62 is an example of a second capacitance element (write capacitor) for holding the second voltage that is different from the first voltage held in the capacitance element 65 and is the next voltage to be held in the capacitance element 65. The capacitance element 62 serves as memory for temporarily holding the next voltage to be held in the capacitance element 65. In detail, the first electrode (the electrode on the node A side) of the capacitance element 62 is connected to the source signal line 88 via the switch 61. The second electrode (the electrode on the node B side) of the capacitance element 62 is connected to the reference power line 83 ($V_{REF}$) for supplying the reference voltage $V_{REF}$.

In this embodiment, the second voltage is written to and held in the capacitance element 62 under control of the display panel control circuit 2, in a first period in the light emission period during which the organic EL element 68 emits light.

The switch 61 is an example of a first switch that switches between conduction and nonconduction between the source signal line 88 (signal line) for supplying the data signal voltage and the first electrode of the capacitance element 62. In detail, the switch 61 is a switching transistor having one of the drain and source terminals connected to the source signal line 88, the other one of the drain and source terminals connected to the first electrode of the capacitance element 62, and the gate connected to the gate signal line 84. In other words, the switch 61 has a function of writing to the capacitance element 62 (write capacitor) for temporarily holding the data signal voltage (data signal) corresponding to the video signal voltage (video signal) supplied via the source signal line 88.

The switch 63 is an example of a second switch that switches between conduction and nonconduction between the first electrode of the capacitance element 62 and the second electrode of the capacitance element 65. In detail, the switch 63 is a switching transistor having one of the drain and source terminals connected to the first electrode of the capacitance element 62, the other one of the drain and source terminals connected to the second electrode of the capacitance element 65, and the gate connected to the gate signal line 85. In other words, the switch 63 has a function of supplying (copying) the second voltage held in the capacitance element 62 to the capacitance element 65.

The switch 64 is an example of a third switch that switches between conduction and nonconduction between the reference power line 83 ($V_{REF}$) for supplying the reference voltage $V_{REF}$ and the second electrode of the capacitance element 65. In detail, the switch 64 is a switching transistor having one of the drain and source terminals connected to the reference power line 83 ($V_{REF}$), the other one of the drain and source terminals connected to the gate electrode of the drive transistor 66 and the second electrode of the capacitance element 65, and the gate connected to the gate signal line 86. In other words, the switch 64 has a function of supplying the reference voltage ($V_{REF}$) to the second electrode of the capacitance element 65 and the gate electrode of the drive transistor 66.

The switch 67 is an example of a fourth switch that switches between conduction and nonconduction between the source electrode of the drive transistor 66 and the anode of the organic EL element 68. In detail, the switch 67 is a switching transistor having one of the drain and source terminals connected to the source electrode of the drive transistor 66, the other one of the drain and source terminals connected to the anode of the organic EL element 68, and the gate connected to the gate signal line 87.

In the pixel structure in this embodiment, a video signal voltage can be written to the pixel even in the state where current is supplied to the organic EL element 68, as illustrated in FIG. 3. The voltage corresponding to the video signal written to the pixel in the previous frame period is held in the capacitor (the capacitance element 65), and the drive transistor 66 supplies current to the organic EL element 68 based on the voltage held in the capacitance element 65.

In the current frame period, the gate driver IC (circuit) sequentially selects pixel rows, and the source driver IC applies a video signal to each selected pixel (display pixel). In the pixel, the voltage corresponding to the video signal is held in the capacitance element 62. In each blanking period of one frame, the voltage held in the capacitance element 62 is copied to the capacitance element 65. During this period, the display screen is kept in a non-display state.

In the next frame, the drive transistor 66 supplies current to the organic EL element 68, based on the voltage held in the capacitance element 65.

As described above, the pixel according to this embodiment includes the capacitance element 65 and the capacitance element 62 each of which holds a voltage based on a video signal.

Although this embodiment describes the case where the capacitance element 65 and the capacitance element 62 each of which holds a voltage based on a video signal are provided, this is not a limitation. For example, two memory circuits may be formed using transistors, etc., and each memory circuit may hold a voltage based on a video signal. Moreover, the gate capacitor of each MOS transistor may hold a voltage based on a video signal.

The features described above are equally applicable to the other embodiments in this description, and may be combined with the other embodiments. Although this embodiment describes the case where the switches 61, 63, 64, and 67 in the pixel circuit 60 are p-type TFTs, this is not a limitation, and the switches may be n-type TFTs.

1-3. Structure of Adjustment Unit

The following describes the adjustment unit 7 illustrated in FIG. 1.

Figure 4:
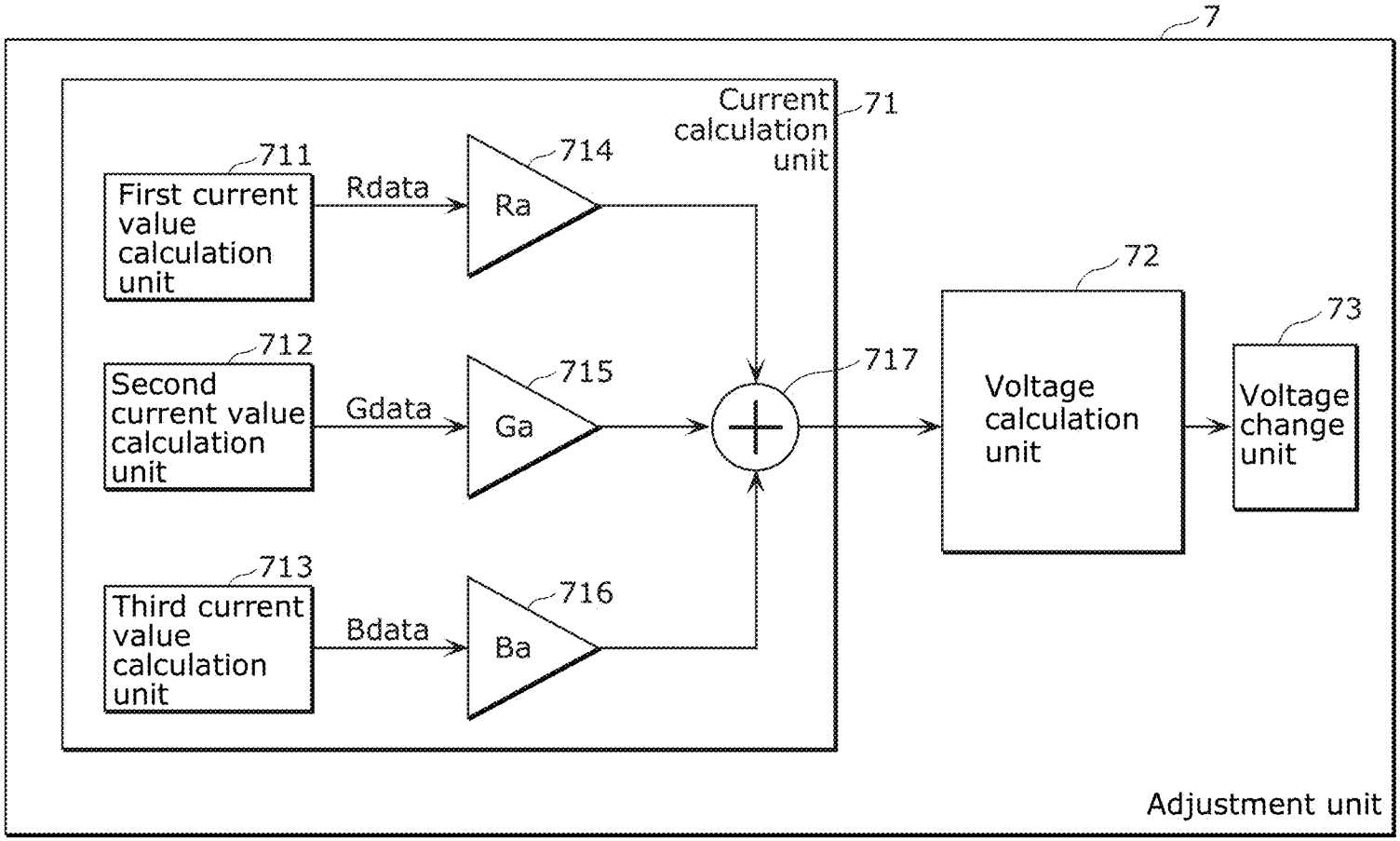
FIG. 4 is a diagram illustrating an example of the structure of an adjustment unit according to Embodiment 1.

FIG. 4 is a diagram illustrating an example of the structure of the adjustment unit according to Embodiment 1.

The adjustment unit 7 includes a current calculation unit 71, a voltage calculation unit 72, and a voltage change unit 73, and adjusts the predetermined voltage (cathode voltage $V_{EL}$) applied to the EL cathode power line 82 connected to the plurality of display pixels.

The current calculation unit 71 calculates the current value flowing in the organic EL display panel 6 in the case where the data signal voltage based on the display data (video data) included in the display data signal S1 is supplied to the organic EL display panel 6.

In more detail, the current calculation unit 71 includes a first current value calculation unit 711, a second current value calculation unit 712, a third current value calculation unit 713, a weighting unit 714, a weighting unit 715, a weighting unit 716, and an addition unit 717.

The first current value calculation unit 711 calculates the current value (first current value) flowing in the organic EL display panel 6 in the case where a red data signal voltage which is the signal voltage of red data (Rdata) included in the display data (video data) is supplied to the organic EL display panel 6. Likewise, the second current value calculation unit 712 and the third current value calculation unit 713 calculate the respective current values (second current value and third current value) flowing in the organic EL display panel 6 in the case where a green data signal voltage of green data (Gdata) and a blue data signal voltage of blue data (Bdata) included in the display data (video data) are supplied to the organic EL display panel 6.

The weighting unit 714 weights the first current value calculated by the first current value calculation unit 711, and outputs the weighted first current value to the addition unit 717. The weighting is performed because of the difference of the color light emission efficiency of the organic EL element 68 depending on the material and the like. In this embodiment, for example, the weighting unit 714 weights the first current value by 2, i.e. multiplies the first current value by 2, and outputs the weighted first current value to the addition unit 717. Likewise, the weighting unit 715 weights the second current value calculated by the second current value calculation unit 712 and outputs the weighted second current value to the addition unit 717, and the weighting unit 716 weights the third current value calculated by the third current value calculation unit 713 and outputs the weighted third current value to the addition unit 717. In this embodiment, for example, the weighting unit 715 weights the second current value by 1, and the weighting unit 716 weights the third current value by 5.

The addition unit 717 outputs a total current value by adding (summing) the weighting units 714, 715, and 716, to the voltage calculation unit 72. The total current value is the current value flowing in the organic EL display panel 6 in the case where the data signal voltage based on the display data included in the display data signal S1 is supplied to the organic EL display panel 6.

Although this embodiment describes the case where the current calculation unit 71 calculates the total current value to facilitate understanding, this is not a limitation. Any value, magnitude, change amount, or the like may be used as long as it has proportionality or predetermined correlation to the current or power flowing in the display screen of the organic EL display panel 6.

In the case where the cathode voltage $V_{EL}$ and the anode voltage $V_{TFT}$ are fixed, for example, a current-correlation value is calculated from the display data (video data), and the current-correlation value and the cathode voltage $V_{EL}$, the anode voltage $V_{TFT}$, or the like are multiplied to obtain a power-correlation value. In the case where the cathode voltage $V_{EL}$, the anode voltage $V_{TFT}$, or the like is changed by the voltage change unit 73, etc., the current-correlation value and the changed cathode voltage $V_{EL}$ or anode voltage $V_{TFT}$ are multiplied to obtain the power-correlation value.

Not all display data (video data) forming the display screen may be used to calculate the current. As an example, display data (video data) corresponding to any pixels selected in the display screen may be used to calculate the current. The total current flowing in the display screen can be estimated by proportional multiplication on the selected pixels. This reduces the calculation time and the number of operations to calculate the current value.

As another example, display data (video data) whose gray level is not less than a predetermined gray level may be used to calculate the current. The value corresponding to the current may be calculated from the number of pixels of display data (video data) whose gray level is not less than the predetermined gray level. The voltage calculation unit 72 determines whether or not to change the predetermined voltage applied to the EL cathode power line 82, based on the total current value output from the addition unit 717. In the case where the predetermined voltage is to be changed, the voltage calculation unit 72 calculates a voltage to be applied to the EL cathode power line 82. In more detail, in the case where the total current value output from the addition unit 717 is greater than or equal to a predetermined threshold, the voltage calculation unit 72 determines that the predetermined voltage applied to the EL cathode power line 82 is to be changed, and calculates, as the voltage to be applied to the EL cathode power line 82, a voltage higher than the predetermined voltage.

Figure 5:
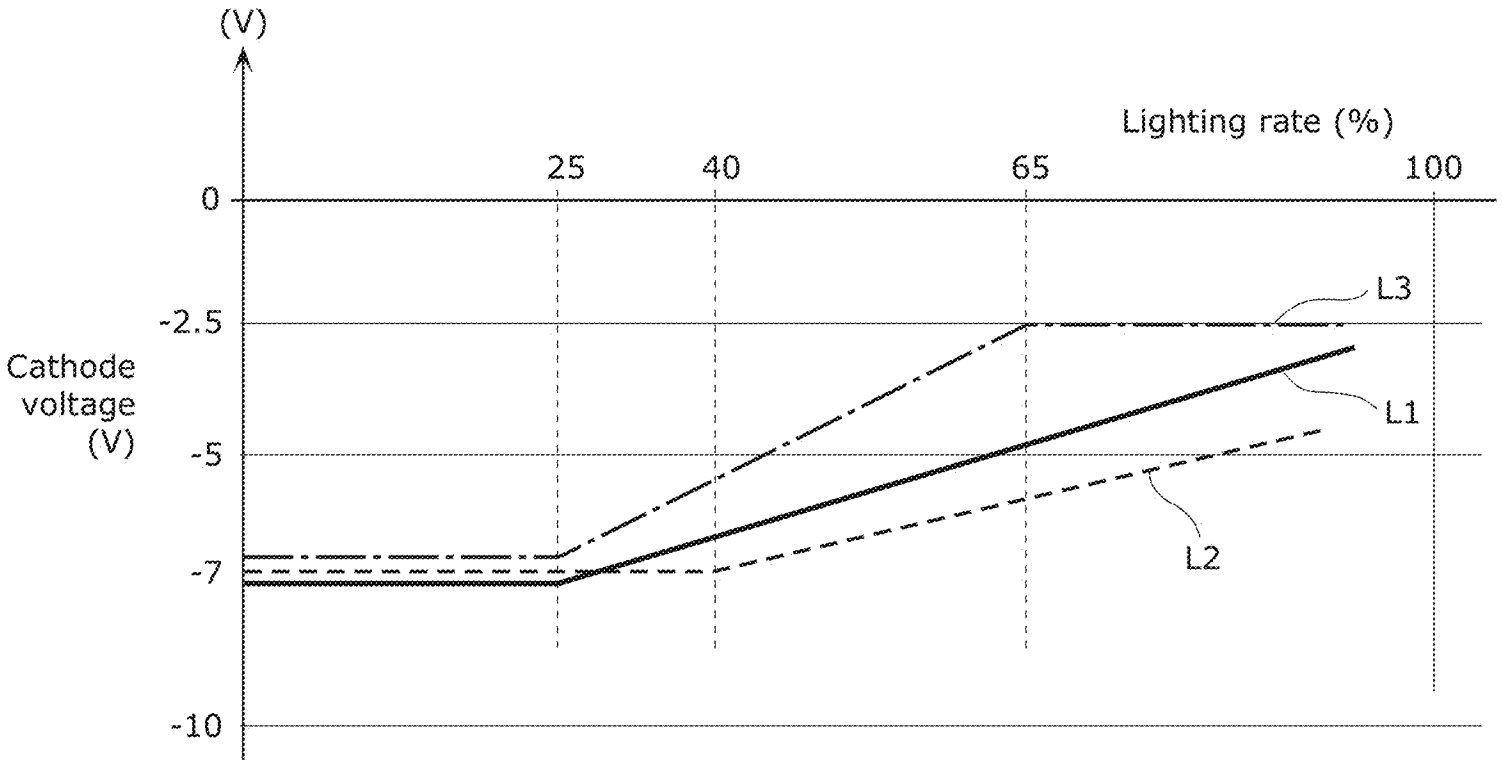
FIG. 5 is a diagram illustrating an example of the voltage adjustment method of the adjustment unit according to Embodiment 1.

The voltage change unit 73 changes the voltage (cathode voltage) to the voltage value calculated by the voltage calculation unit 72. For example, suppose the voltage of the EL cathode power line 82 is −6 V in the case where the current flowing in the organic EL display panel 6 is in a predetermined value range (normal range). In the case where the current flowing in the EL display panel becomes greater than or equal to the predetermined value, the voltage change unit 73 changes the voltage of the EL cathode power line 82 to −4 V. By changing the voltage of the EL cathode power line 82 from −6 V to −4 V, the potential difference between the EL anode power line 81 and the EL cathode power line 82 decreases, so that the power used by the EL display panel can be reduced. FIG. 5 is a diagram illustrating an example of the voltage adjustment method of the adjustment unit according to Embodiment 1.

In FIG. 5, the horizontal axis represents the lighting rate (%). As an example, the lighting rate is obtained by adding gray level data of a video signal and the like.

For example, suppose the maximum value of gray level data is 255. When the gray level data applied to 10 pixels (display pixels) are all 16, the total sum is 16×10=160, and the lighting rate is 160/(255×10)=0.0627 (6.27%). When the gray level data applied to 10 pixels (display pixels) are all 255, the total sum is 255×10=2550, and the lighting rate is 2550/(255×10)=1.0 (100%). The lighting rate has a maximum value of 100%, and a minimum value of 0%. Here, the lighting rate needs to be weighted by the light emission efficiency of each color of light emitting element such as red (R), green (G), and blue (B).

In the organic EL display panel 6, the light emission efficiency differs among the EL elements of red (R), green (G), and blue (B). Accordingly, gray level data is multiplied by a weighting factor depending on the color of R, G, or B, to calculate added data on the display screen. In the case of R, G, B, and W (white), each of the four colors is weighted based on the light emission efficiency.

The light emission efficiency corresponding to the current flowing in the organic EL element needs to be converted. In the case where the gray level data is gamma-transformed, for example, the gray level data is subject to calculation with a gamma transformation coefficient, to obtain the current flowing through the organic EL element. The obtained current is weighted based on the light emission efficiency of the corresponding light emission color. For example, suppose the weighting factor of green (G) is 1. If the light emission efficiency of red (R) is ½ of green (G), the weighting factor of red (R) is 2. If the light emission efficiency of blue (B) is ⅕ of green (G), the weighting factor of blue (B) is 5.

A lighting rate of 0% indicates the state where the display screen is black and all pixels are unlit. In this state, ideally no current flows through the organic EL elements of the display screen. A lighting rate of 100% indicates the state where the display screen is white with the maximum luminance (maximum brightness). In this state, all pixels of the display screen are at the maximum gray level, and the current flowing in the display screen is the maximum current.

Basically, the current I flowing through an organic EL element and the luminance B of the organic EL element are proportional to each other. In the case where the gray level data and the current flowing through the organic EL element based on the gray level data are proportional to each other, the lighting rate can be calculated by multiplying the current flowing through the EL element of each light emission color by the corresponding weighting factor. The lighting rate is obtained by weighting the current flowing in the display screen based on the light emission efficiency of each of the light emission colors arranged in a matrix.

Let Ix be the current flowing in the display screen in a given image display state, and Im be the current flowing in the display screen in the white display state where the whole display screen has the maximum luminance (maximum brightness). Then, the lighting rate (%)=Ix/Im×100. Here, the cathode voltage and the anode voltage are constant (fixed).

Although the above describes the case where the current flowing in the display screen (or the current-correlation value) is obtained from the gray level data, this is not a limitation. For example, the current of each of R, G, and B flowing through the cathode line or anode line may be measured by an ammeter or the like, to perform weighting using the current of each of R, G, and B. The current flowing in the display screen may be measured, to calculate the lighting rate from the measured current. Moreover, a pickup resistor may be placed in series in the EL cathode power line 82 or the EL anode power line 81, to measure the voltage across the pickup resistor by a voltmeter and obtain the current flowing in the display screen.

With the current data obtained from the gray level data or the current obtained by direct current measurement, the consumed current (consumed power) flowing in the display screen can be calculated in the case where the anode voltage and the cathode voltage are fixed. The consumed current and the value obtained by weighting the video signal of R, G, B, or the like based on the EL element efficiency are correlated with each other.

The consumed current (consumed power) flowing in the display area is calculated. In the case of R, G, B, and W (white), each of the four colors is weighted based on the corresponding light emission efficiency.

Although the above describes the case where the lighting rate is calculated from the gray level data or the current flowing in the whole display screen, this is not a limitation. The lighting rate may be obtained by estimating or calculating the gray level data sum or current of the whole display screen from the gray level data sum or current of a part of the display screen (e.g. ¼ of the display screen). The lighting rate need not necessarily be calculated from the gray level data sum or current of one frame period. For example, the gray level data sum or current of each of a plurality of frames may be averaged or transfer-integrated to obtain the lighting rate.

In FIG. 5, in the case where the lighting rate is 0% to 25%, the cathode voltage is constant at −7 V in the lines of all examples. In the case where the lighting rate is low, i.e. 25% or less, even when the cathode voltage is low (the absolute value of the anode-cathode voltage is high), the current flowing in the display screen is small and the panel heat generation is low, and so there is no need to perform current limitation. In the case where the lighting rate is high, the current flowing in the display screen is large, and accordingly the cathode voltage is increased.

In detail, the adjustment unit 7 adjusts the voltage applied to the EL cathode power line 82 to be higher than the predetermined voltage ($V_{EL}$) (so that the potential difference between the anode voltage and the cathode voltage is lower), when the total sum of current (or the lighting rate) corresponding to the second voltage in the case where the current corresponding to the second voltage is supplied to the organic EL element 68 in each of the plurality of display pixels is greater than or equal to a threshold. In more detail, the voltage change unit 73 does not change the cathode voltage steeply, but changes the cathode voltage along straight line L1 having a constant gradient as illustrated in FIG. 5 as an example. The voltage adjustment method is not limited to changing the cathode voltage along straight line L1. The cathode voltage may be changed along straight line L2 having a gentler gradient than straight line L1. Alternatively, the cathode voltage may be changed as indicated by line L3, where the voltage is adjusted from a certain lighting rate of 25% and maintained constant when the lighting rate is 65% or more.

Figure 6:
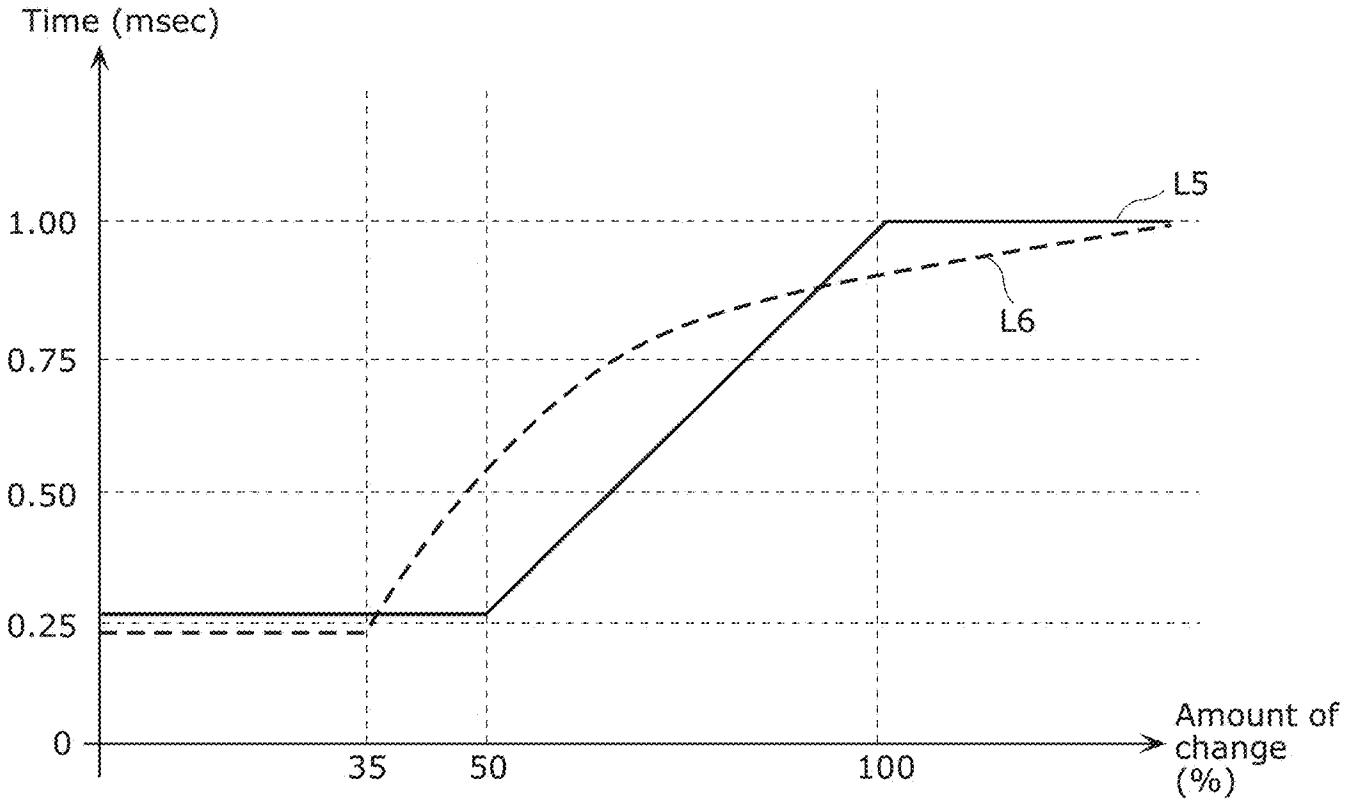
FIG. 6 is a diagram illustrating the response time of the adjustment unit upon a voltage change according to Embodiment 1.

FIG. 6 is a diagram illustrating the response time of the adjustment unit upon a voltage change according to Embodiment 1. In FIG. 6, the vertical axis represents the response time (the order of msec), and the horizontal axis represents the amount of change of the total current value (or the lighting rate). The voltage change unit 73 is not limited to changing the cathode voltage steeply at an inflection point along straight line L5, but may change the cathode voltage smoothly along curved line L6.

Thus, the adjustment unit 7 may adjust the voltage applied to the EL cathode power line 82 to be lower than the predetermined voltage, when the total sum of current or gray level (the lighting rate) corresponding to the second voltage in the case where the current corresponding to the second voltage is supplied to the organic EL element 68 in each of the plurality of display pixels is greater than or equal to the threshold.

In this embodiment, when the total sum of current or gray level (the lighting rate) corresponding to the second voltage is greater than or equal to the threshold, the adjustment unit 7 adjusts the voltage applied to the EL cathode power line 82 to be lower than the predetermined voltage, in the non-light emission period of the pixel circuit 60. The timing of adjustment will be described in detail later.

In this way, the adjustment unit 7 performs overload control so that the panel power due to the current flowing into the organic EL display panel 6 is less than a predetermined level. A decrease in life of the organic EL elements 68 can thus be prevented. The current corresponding to the applied voltage (gray level signal voltage) is caused to flow through the organic EL element 68 by the drive transistor 66. If the current flowing through the display pixels (organic EL elements 68) constituting the organic EL display panel 6 is large, the organic EL display panel 6 generates heat, which leads to shorter life (degradation) of the organic EL elements 68.

Figure 7:
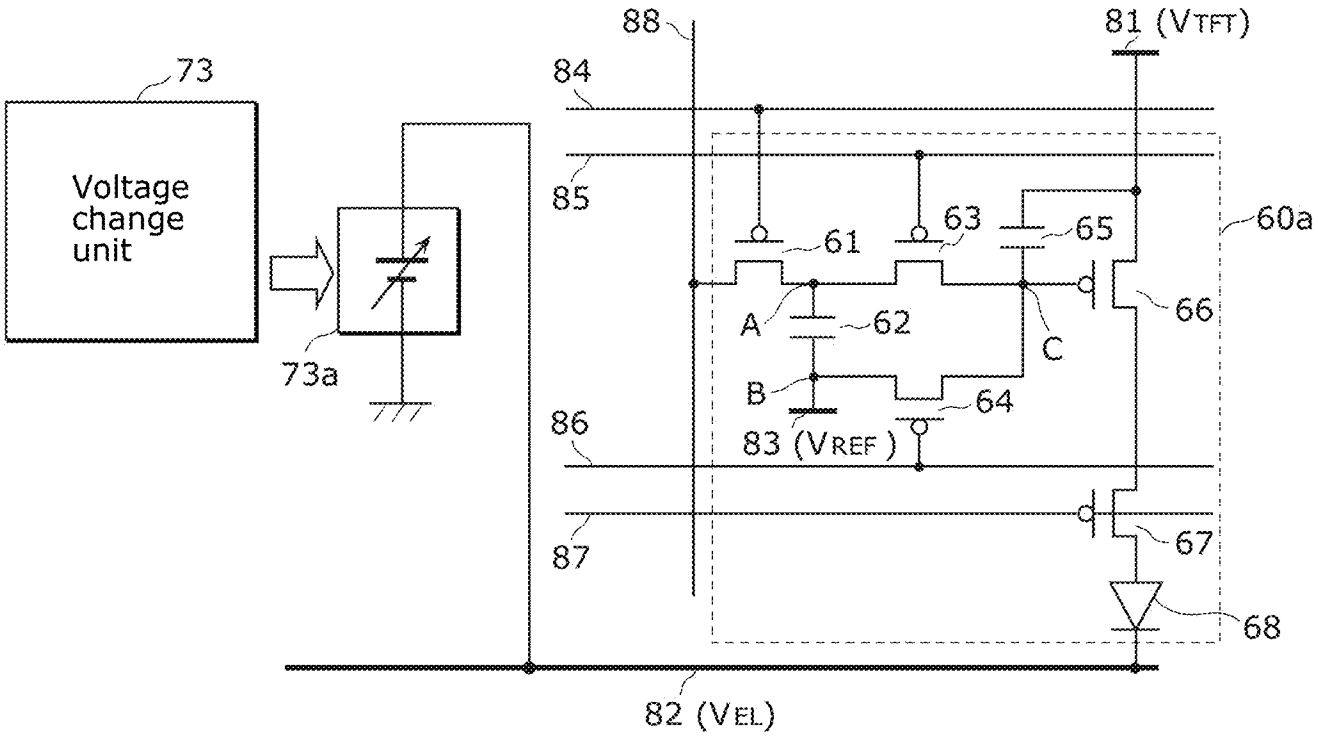
FIG. 7 is a diagram illustrating the relationship between the adjustment unit and the pixel circuit according to Embodiment 1.

FIG. 7 is a diagram illustrating the relationship between the adjustment unit and the pixel circuit according to Embodiment 1. The same elements as in FIGS. 3 and 4 are given the same reference signs, and their detailed description is omitted.

The adjustment unit 7 (the voltage change unit 73) changes the voltage $V_{EL}$ of the EL cathode power line 82 of a pixel circuit 60*a* (the voltage $V_{EL}$ of a voltage source 73*a*) to the voltage value calculated by the voltage calculation unit 72.

Figure 8:
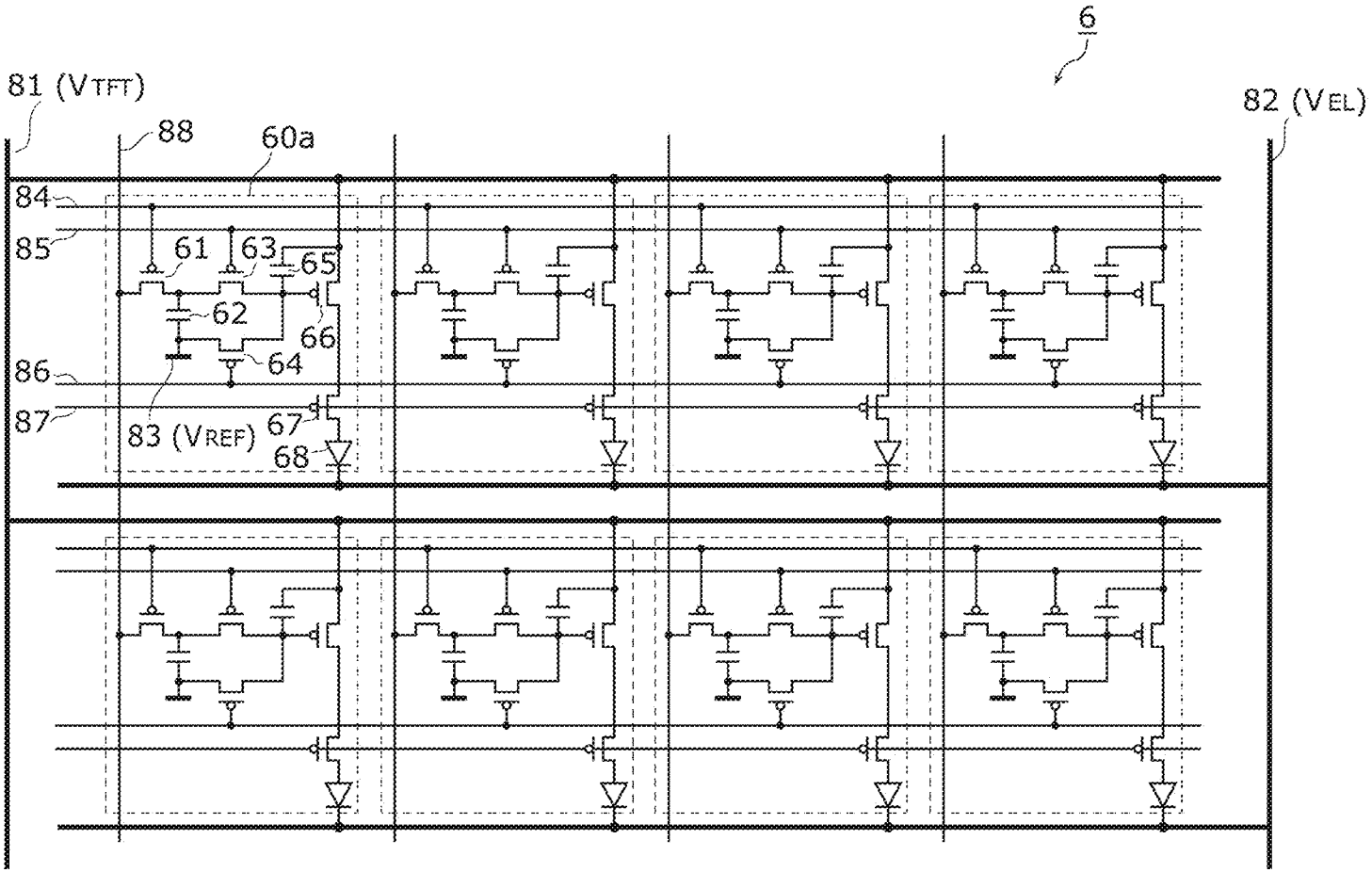
FIG. 8 is a diagram illustrating the relationship between the pixel circuits and the power lines according to Embodiment 1.

FIG. 8 is a diagram illustrating the relationship between the pixel circuits and the power lines according to Embodiment 1.

The pixel circuits 60*a* are arranged in a matrix in the organic EL display panel 6, as illustrated in FIG. 8. Each of the EL anode power line 81 and EL cathode power line 82 is not provided for each of the pixel circuits 60*a* individually but provided as a power line common to the plurality of pixel circuits 60*a*, as illustrated in FIG. 7.

1-4. Operation of Display Pixel

The following describes the method of driving the pixel circuit illustrated in FIG. 3, with reference to FIGS. 9A to 9E.

With the structure of the pixel circuit 60 illustrated in FIG. 3, the display pixel can perform the process of writing a luminance signal and the process of emitting light by the organic EL element independently of each other. In detail, the display pixel in this embodiment, i.e. the pixel circuit 60 illustrated in FIG. 3, is driven through a write process, a reset process, a copy process, a voltage adjustment process, and a light emission process. The driving method in this embodiment is realized by performing the five processes illustrated in FIGS. 9A to 9E with the structure of the pixel circuit 60 illustrated in FIG. 3.

FIGS. 9A to 9E are diagrams illustrating an example of the operation of the pixel circuit according to Embodiment 1. FIGS. 9A to 9E illustrate the operations in the scenes corresponding to the write process, the reset process, the copy process, the voltage adjustment process, and the light emission process. The same elements as in FIG. 3 are given the same reference signs, and their detailed description is omitted.

(Write Process)

Figure 9A:
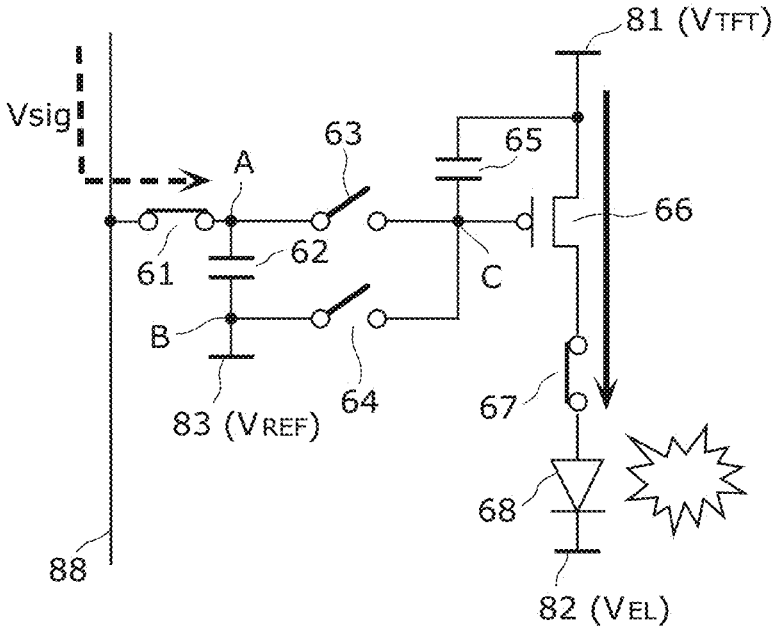
FIG. 9A is a diagram illustrating an example of the operation of the pixel circuit illustrated in FIG. 3.

FIG. 9A illustrates the operation scene of the write process which is executed in the first period in the light emission period during which the organic EL element 68 emits light. The write process is a process of writing a video signal voltage (Vsig) for the next light emission period to the capacitance element 62 in the first period in the light emission period during which the organic EL element 68 emits light according to the current video signal voltage of the capacitance element 65, as illustrated in FIG. 9A.

In this embodiment, first, the switches 63 and 64 are maintained nonconducting (off), the switch 67 is maintained conducting (on), and the drive transistor 66 supplies the current corresponding to the voltage held in the capacitance element 65 to the organic EL element 68 so that the organic EL element 68 emits light (light emission period).

In the first period (write period) in the light emission period, the switch 61 is rendered conducting (on), to cause the capacitance element 62 to hold the next voltage (video signal voltage Vsig) to be held by the capacitance element 65. In other words, in this embodiment, the display panel control circuit 2 causes the second voltage (the next video signal voltage) to be written to and held in the capacitance element 62 in the light emission period (in the first period) during which the organic EL element 68 emits light, in each of the plurality of pixel circuits 60. The aforementioned operation is performed from the top pixel row to bottom pixel row of the screen sequentially. In detail, the gate driver circuit 3 performs shift operation to sequentially select the pixel row position to which the video signal is applied.

Thus, in the pixel circuit 60 in this embodiment, in the first period in the light emission period during which the organic EL element 68 emits light according to the voltage (video signal voltage) held in the capacitance element 65, the voltage (video signal voltage) to be held in the capacitance element 65 in the next light emission period can be written to and held in the capacitance element 62 beforehand. In other words, the pixel circuit 60 according to this embodiment can write the next video signal voltage (video data) to the pixel circuit 60 even during the light emission of the organic EL element 68. Hence, the next image display can be written to each pixel while holding the image display state of the display screen.

(Reset Process)

Figure 9B:
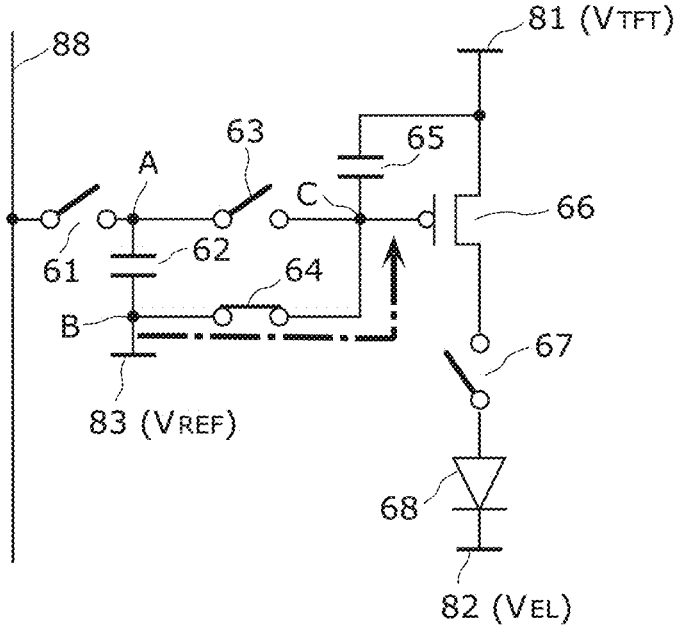
FIG. 9B is a diagram illustrating an example of the operation of the pixel circuit illustrated in FIG. 3.

FIG. 9B illustrates the operation scene of the reset process which is executed in the non-light emission period after the light emission of the organic EL element 68. An example of the non-light emission period is a blanking period. The reset process is a process of resetting the capacitance element 65 in the state where the light emission of the organic EL element 68 is stopped, as illustrated in FIG. 9B.

In this embodiment, in the non-light emission period during which the switch 67 is nonconducting (off), the switch 64 is rendered conducting (on) while maintaining the switches 61 and 63 nonconducting (off), to input the voltage $V_{REF}$ to one end of the capacitance element 65. The reset process of initializing the capacitance element 65 is carried out in this way.

(Copy Process)

Figure 9C:
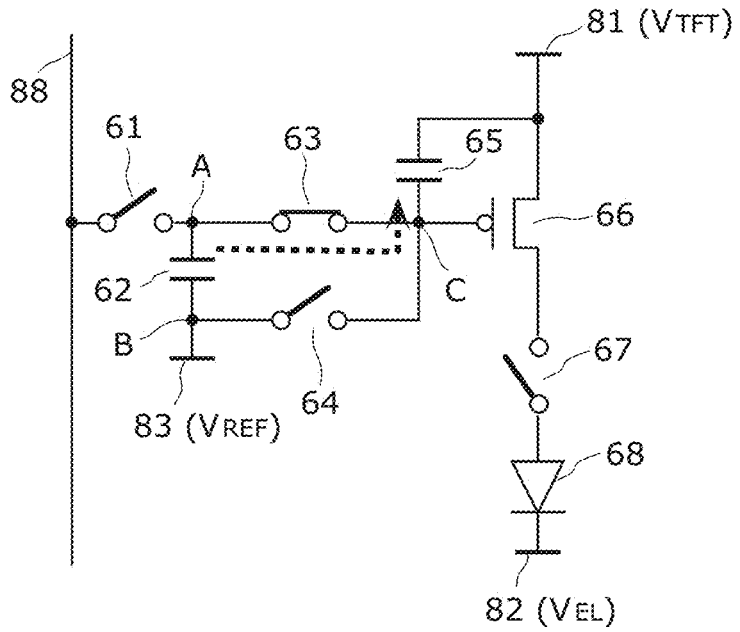
FIG. 9C is a diagram illustrating an example of the operation of the pixel circuit illustrated in FIG. 3.

FIG. 9C illustrates the operation scene of the copy process which is executed in the second period following the reset process in the non-light emission period during which the light emission of the organic EL element 68 is stopped. The copy process is a process of copying the next video signal voltage (Vsig) held in the capacitance element 62 to the capacitance element 65 in the second period following the reset process in the non-light emission period, as illustrated in FIG. 9C.

In this embodiment, in the second period following the reset process in the non-light emission period during which the switch 67 is nonconducting (off), the switch 64 is rendered nonconducting (off) while maintaining the switch 63 nonconducting (off), and then the switch 63 is rendered conducting (on). As a result, the first electrode of the capacitance element 62 and the second electrode of the capacitance element 65 are connected, and so the next video signal voltage (Vsig) held in the capacitance element 62 can be copied (written) to the capacitance element 65. The video signal voltage held in the capacitance element 62 in each pixel is concurrently copied to the capacitance element 65. In the next frame, an image is displayed according to the video signal voltage copied to the capacitance element 65.

(Voltage Adjustment Process)

Figure 9D:
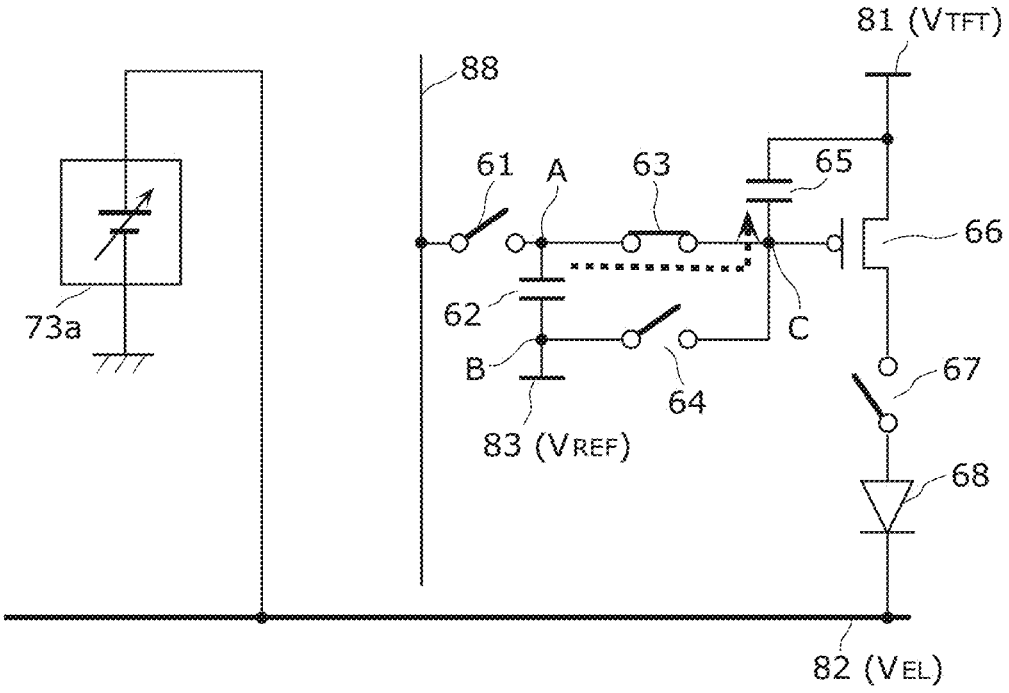
FIG. 9D is a diagram illustrating an example of the operation of the pixel circuit illustrated in FIG. 3.

FIG. 9D illustrates the operation scene of the voltage adjustment process of adjusting the predetermined voltage (cathode voltage) by the adjustment unit 7, which is executed in the non-light emission period during which the light emission of the organic EL element 68 is stopped. The voltage adjustment process is a process of adjusting the cathode voltage of the EL cathode power line 82 (the voltage $V_{EL}$ of the voltage source 73*a*) in the non-light emission period, as illustrated in FIG. 9D.

Although FIG. 9D illustrates the scene where the voltage adjustment process is performed concurrently with the copy process illustrated in FIG. 9C, this is not a limitation. The voltage adjustment process may be performed at any timing in the non-light emission period during which the switch 67 is nonconducting (off).

For example, the reset process, the copy process, and the voltage adjustment process are performed in the blanking period. During these operations, the shift operation of the gate driver circuit is stopped. Moreover, these operations are performed simultaneously on all pixels of the display screen.

The adjustment unit 7 calculates the current flowing in the organic EL display panel 6, from the display data signal S1 of one frame or subfield. Based on the calculation result, the adjustment unit 7 changes (adjusts) the anode voltage to be lower than the predetermined voltage. This enables overload control so that the panel power due to the current flowing into the organic EL display panel 6 is less than a predetermined level. The adjustment unit 7, in combination with the pixel circuit 60 in this embodiment, can perform the anode voltage change as overload control in the non-light emission period before video display, without lowering video quality.

(Light Emission Process)

Figure 9E:
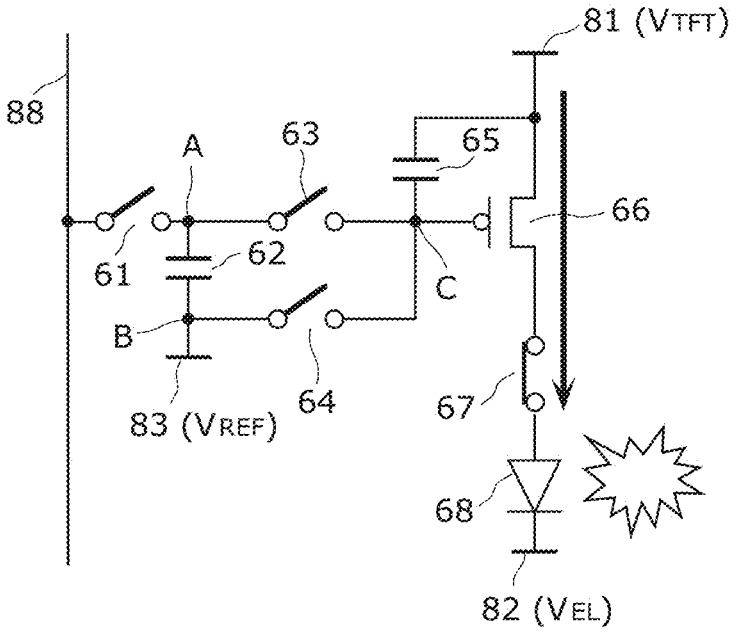
FIG. 9E is a diagram illustrating an example of the operation of the pixel circuit illustrated in FIG. 3.

FIG. 9E illustrates the operation scene of the light emission process where the organic EL element 68 emits light.

In this embodiment, the switch 67 is rendered conducting (on) while maintaining the switches 61, 63, and 64 nonconducting (off). This enables the organic EL element 68 to emit light according to the next video signal voltage (Vsig) held in the capacitance element 65.

By repeatedly executing the write process, the reset process, the copy process, the voltage adjustment process, and the light emission process in the aforementioned manner, video (e.g. a moving image) can be displayed on the plurality of display pixels in this embodiment.

In the light emission process, by changing the switch 67 from nonconduction (off) to conduction (on) simultaneously in all display pixels of the organic EL display panel 6, the frame display can be switched simultaneously in all display pixels. Thus, the display according to the current video signal voltage and the display according to the next video signal voltage can be kept from being mixed.

1-5. Advantageous Effects

As described above, the organic EL display device 1 according to this embodiment can prevent a decrease in life of the organic EL elements 68.

In detail, in a conventional organic EL display device, when performing overload control so that the panel power due to the current flowing into the organic EL panel is less than a predetermined level, the voltage of the power line needs to be decreased during video display. This causes lower video quality such as display unevenness or flicker.

On the other hand, the organic EL display device 1 according to this embodiment includes the adjustment unit 7, and is capable of writing a data signal voltage and displaying video independently of each other. Moreover, the adjustment unit 7 changes the cathode voltage or the like during the blanking period. The video signal is copied to the capacitance element 62 sequentially, and the video signal held in the capacitance element 62 is copied to the capacitance element 65 concurrently in the blanking period. This enables overload control so that the panel power due to the current flowing into the organic EL panel is less than a predetermined level, without lowering video quality or causing flicker when changing the cathode voltage or the like. A decrease in life of the organic EL elements 68 can thus be prevented.

The adjustment unit 7 calculates the current flowing in the organic EL display panel 6, from the display data signal S1 of one frame or subfield. Based on the calculation result, the adjustment unit 7 changes the anode voltage to be lower than the predetermined voltage. This enables overload control so that the panel power due to the current flowing into the organic EL display panel 6 is less than a predetermined level. Moreover, the adjustment unit 7 can perform the anode voltage change as overload control in the non-light emission period before video display. This has the advantageous effect of preventing lower video quality.

Furthermore, since the organic EL display device 1 according to this embodiment can perform overload control, no heat dissipation mechanism to cool the organic EL display panel 6 is needed. This has the advantageous effect of realizing a thinner organic EL display panel 6.

Embodiment 2

While Embodiment 1 describes the case where the thin-film transistors forming the switch 61, switch 63, switch 64, drive transistor 66, and switch 67 are p-type, this is not a limitation, and the thin-film transistors may be n-type. Embodiment 2 describes the case where the thin-film transistors forming the switch 61, switch 63, switch 64, drive transistor 66, and switch 67 are n-type. The following mainly describes the differences from Embodiment 1.

2-1. Circuit Structure of Display Pixel

Figure 10:
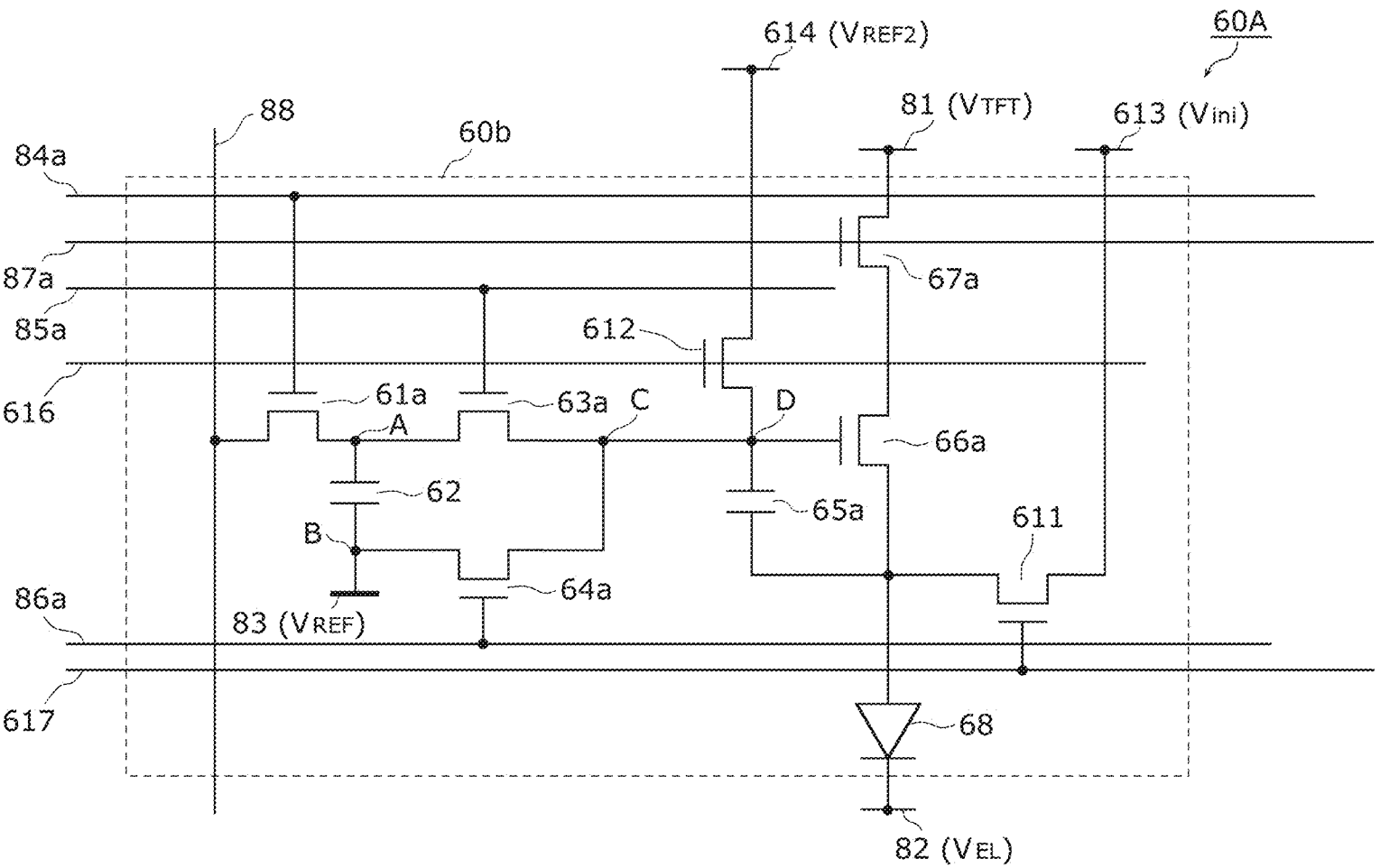
FIG. 10 is a diagram illustrating an example of the circuit structure of a display pixel according to Embodiment 2.

FIG. 10 is a diagram illustrating an example of the circuit structure of the display pixel according to Embodiment 2. The same elements as in FIG. 3 are given the same reference signs, and their detailed description is omitted.

A pixel circuit 60A illustrated in FIG. 10 is one pixel included in the organic EL display panel 6, and has a function of emitting light according to a source signal (data signal voltage) supplied via a source signal line 88.

The pixel circuit 60A is an example of one of the display pixels (light emitting pixels) arranged in a matrix. For example, as illustrated in FIG. 10, the pixel circuit 60A includes a switch 61*a*, a capacitance element 62, a switch 63*a*, a switch 64*a*, a capacitance element 65*a*, a drive transistor 66*a*, a switch 67*a*, an organic EL element 68, a switch 611, and a switch 612. The pixel circuit 60A also includes an EL anode power line 81 ($V_{TFT}$), an EL cathode power line 82 ($V_{EL}$), a reference power line 83 ($V_{REF}$), a gate signal line 84*a*, a gate signal line 85*a*, a gate signal line 86*a*, a gate signal line 87*a*, and a source signal line 88, and further includes an initialization power line 613 ($V_{INI}$), a reference power line 614 ($V_{REF2}$), a control line 616, and an Init line 617.

The initialization power line 613 ($V_{INI}$) is an example of a power line for supplying a voltage $V_{INI}$ (also referred to as an initialization voltage $V_{INI}$) for initializing the voltage between the source and gate of the drive transistor 66*a*, i.e. the voltage of the capacitance element 65*a*. The reference power line 614 ($V_{REF2}$) is an example of a power line for supplying a reference voltage $V_{REF2}$.

The organic EL element 68 is an example of a light emitting element that emits light according to a current supplied from the drive transistor 66*a*. A plurality of light emitting elements are arranged in a matrix.

The drive transistor 66*a* is a voltage-driven drive element that controls the supply of current to the organic EL element 68, and causes the organic EL element 68 to emit light by supplying the current corresponding to the voltage held in the capacitance element 65*a* to the organic EL element 68. In this embodiment, the thin-film transistor (TFT) forming the drive transistor 66*a* is n-type.

The capacitance element 65*a* is an example of a first capacitance element (display capacitor) for holding a first voltage used to cause the organic EL element 68 to emit light. The capacitance element 65*a* holds the voltage for determining the amount of current to be flown by the drive transistor 66*a*. In detail, the first electrode (the electrode opposite to the node D) of the capacitance element 65*a* is connected between the source electrode (on the EL cathode power line 82 side) of the drive transistor 66*a* and the anode of the organic EL element 68. The second electrode (the electrode on the node D side) of the capacitance element 65*a* is connected to the gate electrode of the drive transistor 66*a*. The second electrode of the capacitance element 65*a* is also connected to the initialization power line 613 ($V_{INI}$) via the switch 611.

In this embodiment, a second voltage held in the capacitance element 62 is copied to the capacitance element 65*a* which accordingly holds the second voltage as the first voltage under control of the display panel control circuit 2, in a second period following an initialization period for initializing the capacitance element 65*a* in the non-light emission period after the light emission period during which the organic EL element 68 emits light.

The capacitance element 62 is an example of a second capacitance element (write capacitor) for holding the second voltage that is different from the first voltage held in the capacitance element 65*a* and is the next voltage to be held in the capacitance element 65*a*. The capacitance element 62 serves as memory for temporarily holding the next voltage to be held in the capacitance element 65*a*. In detail, the first electrode (the electrode on the node A side) of the capacitance element 62 is connected to the source signal line 88 via the switch 61*a*. The second electrode (the electrode on the node B side) of the capacitance element 62 is connected to the reference power line 83 ($V_{REF}$) for supplying the reference voltage $V_{REF}$.

In this embodiment, the second voltage is written to and held in the capacitance element 62 under control of the display panel control circuit 2, in a first period in the light emission period during which the organic EL element 68 emits light.

The switch 61*a* is an example of a first switch that switches between conduction and nonconduction between the source signal line 88 (signal line) for supplying the data signal voltage and the first electrode of the capacitance element 62.

The switch 63*a* is an example of a second switch that switches between conduction and nonconduction between the first electrode of the capacitance element 62 and the second electrode of the capacitance element 65*a*.

The switch 64*a* is an example of a third switch that switches between conduction and nonconduction between the reference power line 83 ($V_{REF}$) for supplying the reference voltage $V_{REF}$ and the second electrode of the capacitance element 65*a*.

The switch 67*a* is an example of a fourth switch that switches between conduction and nonconduction between the drain electrode of the drive transistor 66*a* and the EL anode power line 81 ($V_{TFT}$).

The switch 611 switches between conduction and nonconduction between each of the first electrode of the capacitance element 65*a* and the source electrode of the drive transistor 66*a* and the initialization power line 613 ($V_{INI}$). In detail, the switch 611 has one of the drain and source terminals connected to the initialization power line 613 ($V_{INI}$), the other one of the drain and source terminals connected to first electrode of the capacitance element 65*a* and the source electrode of the drive transistor 66*a*, and the gate connected to the Init line 617. In other words, the switch 611 has a function of supplying the initialization voltage $V_{INI}$ to the second electrode of the capacitance element 65*a* and the source electrode of the drive transistor 66*a*.

The switch 612 switches between conduction and nonconduction between the reference power line 614 ($V_{REF2}$) for supplying the reference voltage $V_{REF2}$ and each of the gate electrode of the drive transistor 66*a* and the second electrode of the capacitance element 65*a*. In detail, the switch 612 has one of the drain and source terminals connected to the reference power line 614 ($V_{REF2}$), the other one of the drain and source terminals connected to the gate electrode of the drive transistor 66*a* and the second electrode of the capacitance element 65*a*, and the gate connected to the gate signal line 87*a*. In other words, the switch 612 has a function of supplying the reference voltage ($V_{REF2}$) to the gate electrode of the drive transistor 66*a* and the capacitance element 65*a* to reset the drive transistor 66*a* and the capacitance element 65*a*.

2-2. Structure of Adjustment Unit

The adjustment unit 7 has the same structure as that illustrated in FIG. 4 in Embodiment 1, and so its description is omitted. The following describes the relationship between the adjustment unit 7 and the pixel circuit 60A according to Embodiment 2.

Figure 11:
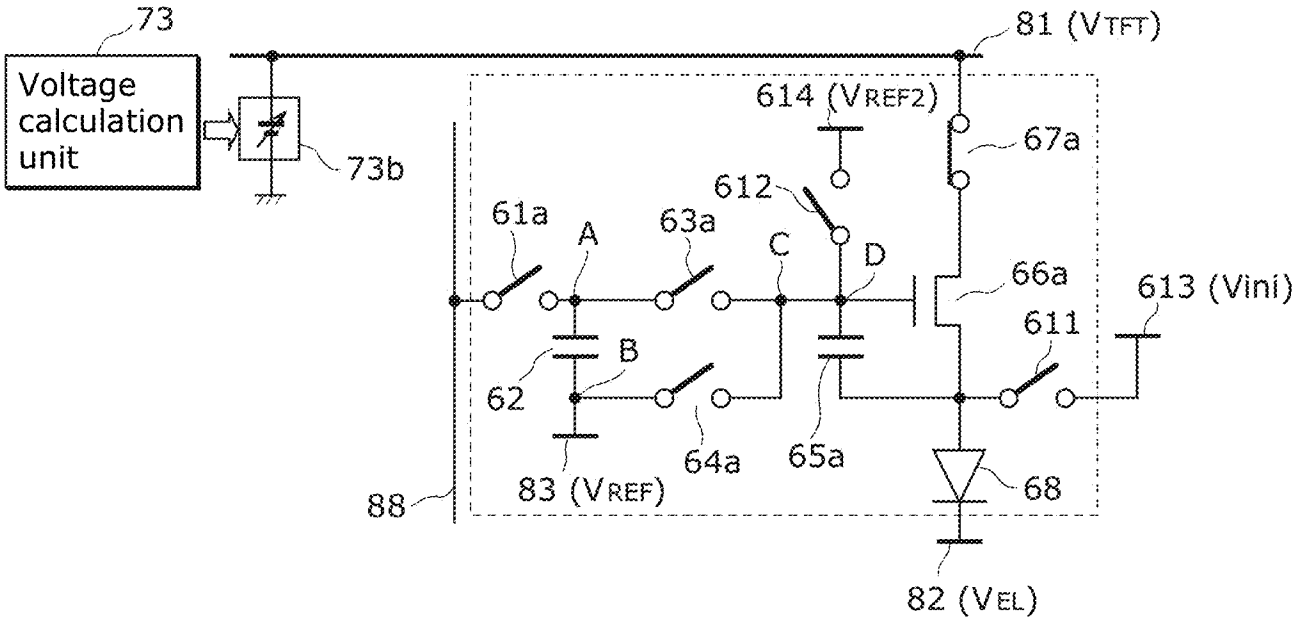
FIG. 11 is a diagram illustrating the relationship between the adjustment unit and the pixel circuit according to Embodiment 2.

FIG. 11 is a diagram illustrating the relationship between the adjustment unit and the pixel circuit according to Embodiment 2. The same elements as in FIGS. 4 and 10 are given the same reference signs, and their detailed description is omitted.

In this embodiment, the adjustment unit 7 (the voltage change unit 73) changes the voltage $V_{TFT}$ of the EL anode power line 81 of a pixel circuit 60*b* (the voltage $V_{TFT}$ of a voltage source 73*b*) to the voltage value calculated by the voltage calculation unit 72.

Thus, the adjustment unit 7 can perform overload control so that the panel power due to the current flowing into the organic EL display panel 6 is less than a predetermined level (see FIG. 5, etc.), and therefore a decrease in life of the organic EL elements 68 can be prevented.

2-3. Operation of Display Pixel

In this embodiment, with the structure of the pixel circuit 60A illustrated in FIG. 10, the display pixel can perform the process of writing a luminance signal and the process of emitting light by the organic EL element independently of each other. In detail, the display pixel in this embodiment, i.e. the pixel circuit 60A illustrated in FIG. 10, is driven through a write process, a reset process, a copy process, a voltage adjustment process, and a light emission process.

FIGS. 12A to 12H are diagrams illustrating an example of the operation of the pixel circuit according to Embodiment 4-2. FIGS. 12A to 12H illustrate the operations in the scenes corresponding to the first write process, the reset process, the copy process (the second write process), the voltage adjustment process, and the light emission process. The same elements as in FIG. 10 are given the same reference signs, and their detailed description is omitted.

(Write Process)

Figure 12A:
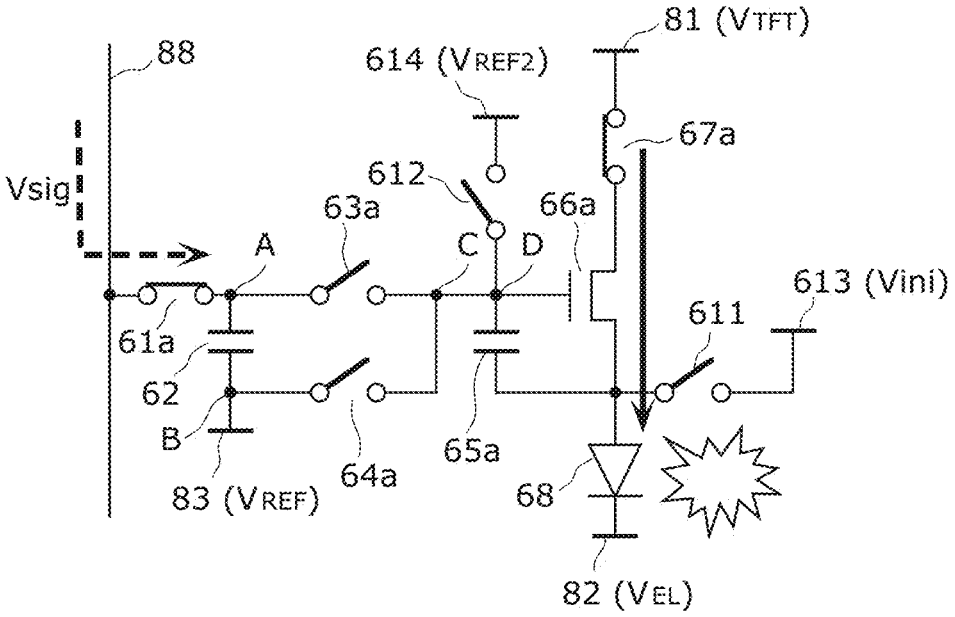
FIG. 12A is a diagram illustrating an example of the operation of the pixel circuit illustrated in FIG. 10.

FIG. 12A illustrates the operation scene of the write process which is a process of writing a video signal voltage (Vsig) for the next light emission period to the capacitance element 62 in the first period in the light emission period during which the organic EL element 68 emits light according to the current video signal voltage of the capacitance element 65*a*.

In the write process, the switches 61*a* and 67*a* are conducting (on), and the switches 63*a*, 64*a*, 611, and 612 are nonconducting (off), as illustrated in FIG. 12A. By setting the switches in this way, the next video signal voltage (Vsig) can be written to the capacitance element 62 while causing the organic EL element 68 to emit light according to the current video signal voltage. The aforementioned operation is performed from the top pixel row to bottom pixel row of the screen sequentially. In detail, the gate driver circuit 3 performs shift operation to sequentially select the pixel row position to which the video signal is applied.

Thus, the pixel circuit 60A according to this embodiment can write the next video signal voltage (video data) to the capacitance element 62 in the pixel circuit 60A even during the light emission of the organic EL element 68.

(Reset Process)

FIGS. 12B to 12E illustrate the operation scene of the reset process which is executed in the non-light emission period after the light emission of the organic EL element 68. An example of the non-light emission period is a blanking period. By changing the states of the switches as illustrated in FIGS. 12B to 12E, the process of resetting the capacitance element 65*a* and the drive transistor 66*a* is carried out.

Figure 12B:
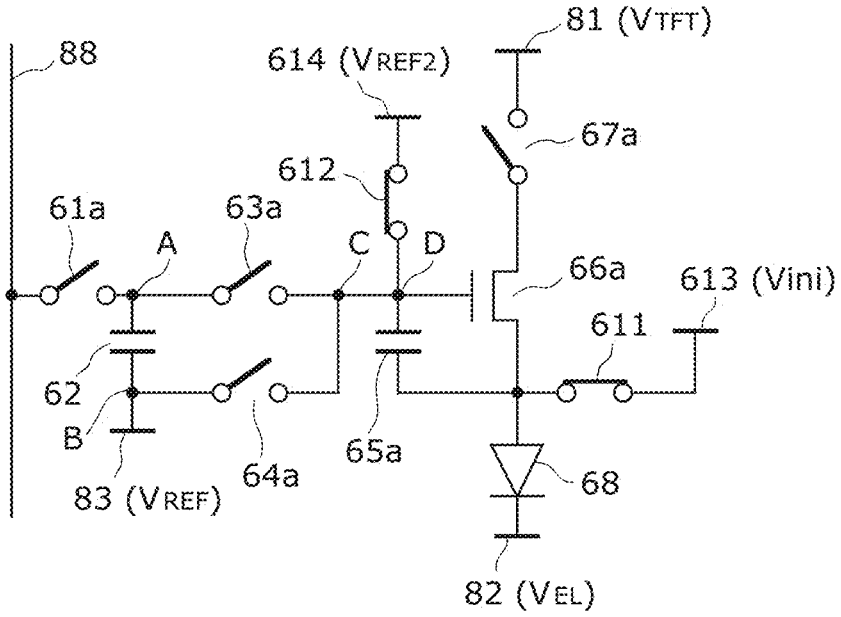
FIG. 12B is a diagram illustrating an example of the operation of the pixel circuit illustrated in FIG. 10.

First, as illustrated in FIG. 12B, the switches 61*a*, 63*a*, 64*a*, and 67*a* are nonconducting (off), and the switches 611 and 612 are conducting (on). As a result, the potential of the node D is set to the voltage $V_{REF2}$ of the reference power line 614. Since the switch 611 is conducting, the potential of the node D is set to the voltage $V_{INI}$ of the initialization power line 613. Hence, the voltage $V_{REF2}$ of the reference power line 614 and the voltage $V_{INI}$ of the initialization power line 613 are applied to the drive transistor 66*a*.

Figure 12C:
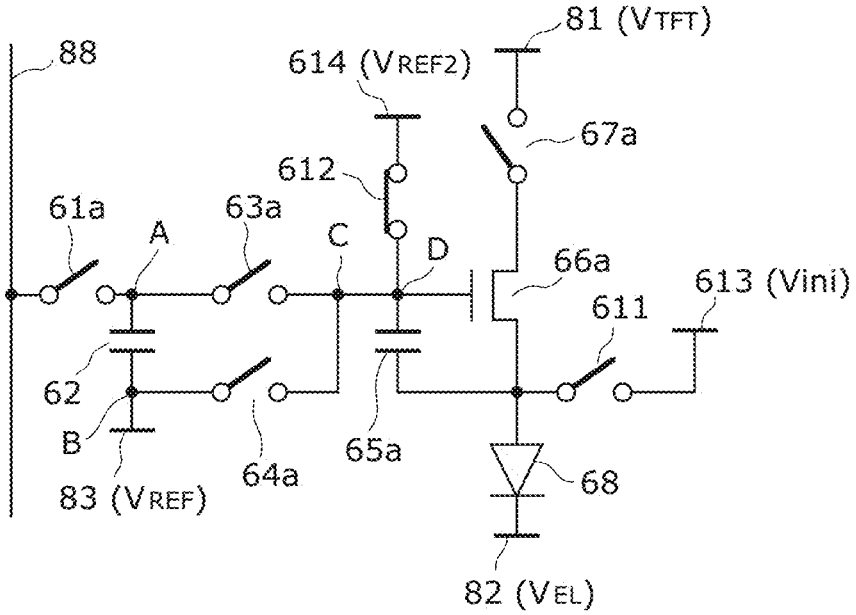
FIG. 12C is a diagram illustrating an example of the operation of the pixel circuit illustrated in FIG. 10.

Next, as illustrated in FIG. 12C, the switch 611 is rendered nonconducting (off) from the state illustrated in FIG. 12B. In detail, having set the switches 61*a*, 63*a*, 64*a*, and 67*a* to be nonconducting (off) and the switch 612 to be conducting (on), the switch 611 is rendered nonconducting (off).

By providing the period during which the switch 611 is nonconducting in this way, the flow of through current between the EL anode power line 81 and the initialization power line 613 can be prevented. In other words, without the period for setting the state in FIG. 12C, the switches 611 and 67*a* are simultaneously conducting, with there being a possibility that through current flows between the EL anode power line 81 and the initialization power line 613 via the switch 67*a*, the drive transistor 66*a*, and the switch 611. The flow of through current is prevented by setting the period illustrated in FIG. 12C.

Figure 12D:
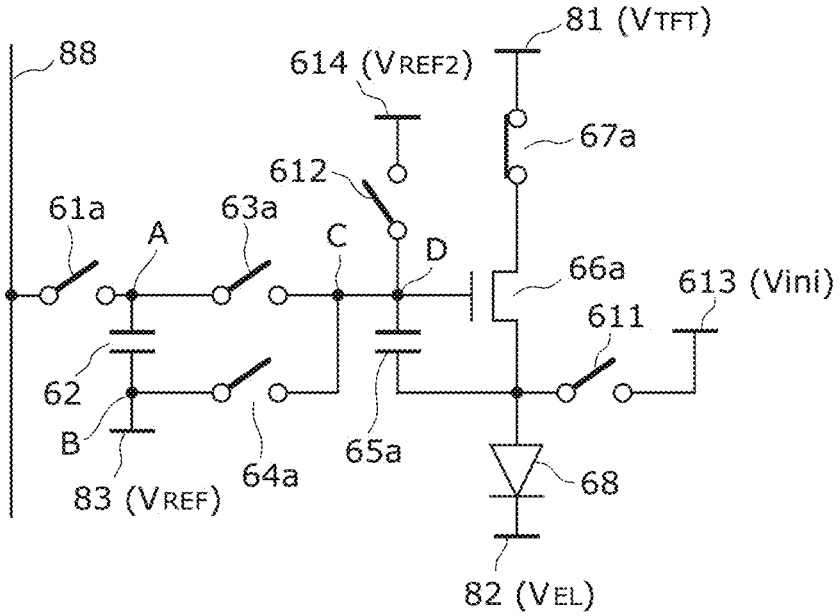
FIG. 12D is a diagram illustrating an example of the operation of the pixel circuit illustrated in FIG. 10.

Next, as illustrated in FIG. 12D, the switch 67*a* is rendered conducting (on) from the state illustrated in FIG. 12C, and then the switch 612 is rendered nonconducting (off). By rendering the switch 67*a* conducting (on) in the state where the reference voltage ($V_{REF2}$) of the reference power line 614 is input to the gate electrode of the drive transistor 66*a*, the threshold compensation operation of the drive transistor 66*a* can be carried out. By rendering the switch 612 nonconducting (off), the threshold compensation operation ends.

Figure 12E:
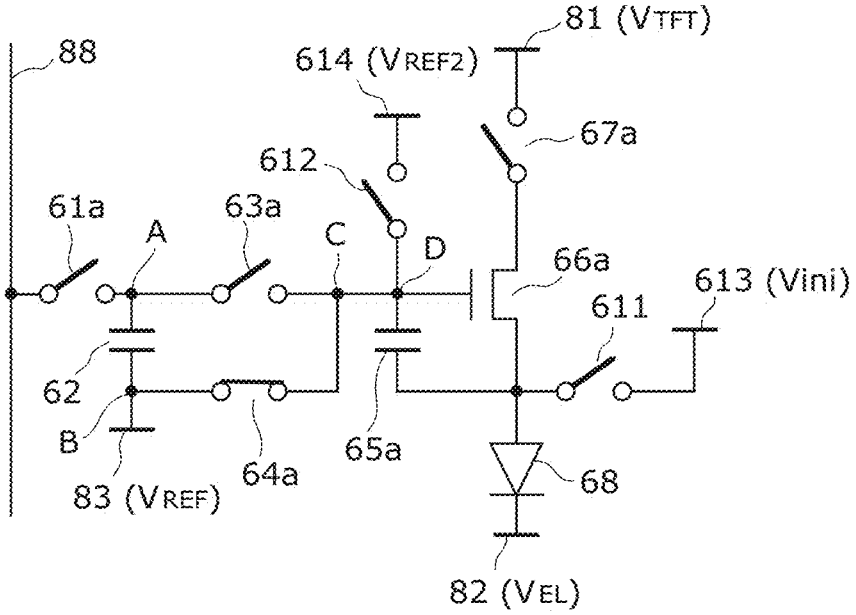
FIG. 12E is a diagram illustrating an example of the operation of the pixel circuit illustrated in FIG. 10.

Next, as illustrated in FIG. 12E, the switch 67*a* is rendered nonconducting (off) from the state illustrated in FIG. 12D, and then the switch 64*a* is rendered conducting (on). Since the switch 64*a* is rendered conducting (on) in the state where the next video signal voltage (Vsig) is held in the capacitance element 62, the voltage $V_{REF}$ of the reference power line 83 is input to the second electrode of the capacitance element 65*a*. The capacitance element 65*a* is thus reset (initialized).

(Copy Process)

Figure 12F:
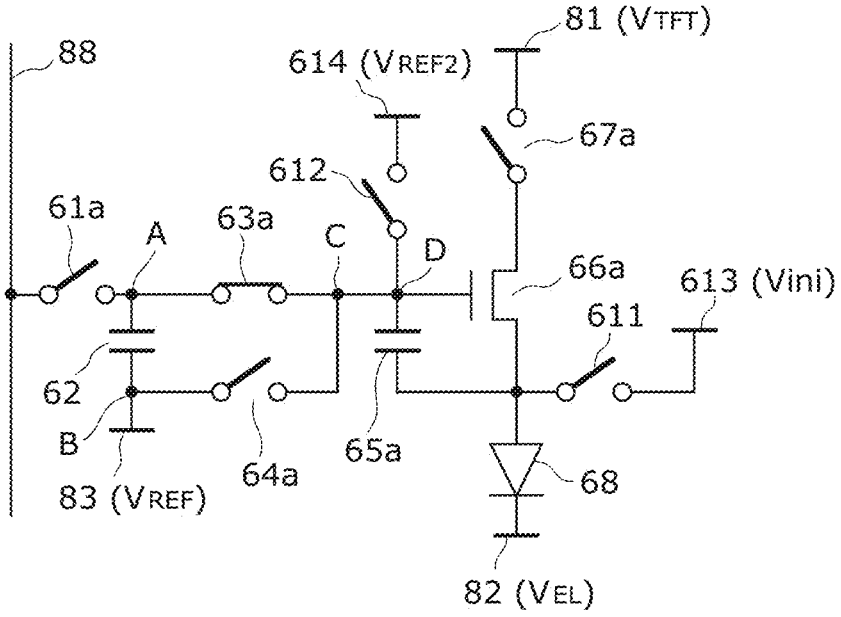
FIG. 12F is a diagram illustrating an example of the operation of the pixel circuit illustrated in FIG. 10.

FIG. 12F illustrates the operation scene of the copy process which is executed in the second period following the reset process in the non-light emission period. The copy process is a process of copying the next video signal voltage (Vsig) held in the capacitance element 62 to the capacitance element 65*a* in the second period following the reset process in the non-light emission period, as illustrated in FIG. 12F.

In this embodiment, in the second period following the reset process in the non-light emission period during which the switch 67*a* is nonconducting (off), the switch 63*a* is rendered conducting (on) while maintaining the switches 61*a*, 67*a*, 611, 611, and 612 nonconducting (off). As a result, the first electrode of the capacitance element 62 and the second electrode of the capacitance element 65*a* are connected, and so the next video signal voltage (Vsig) held in the capacitance element 62 can be copied (written) to the capacitance element 65*a*.

(Voltage Adjustment Process)

Figure 12G:
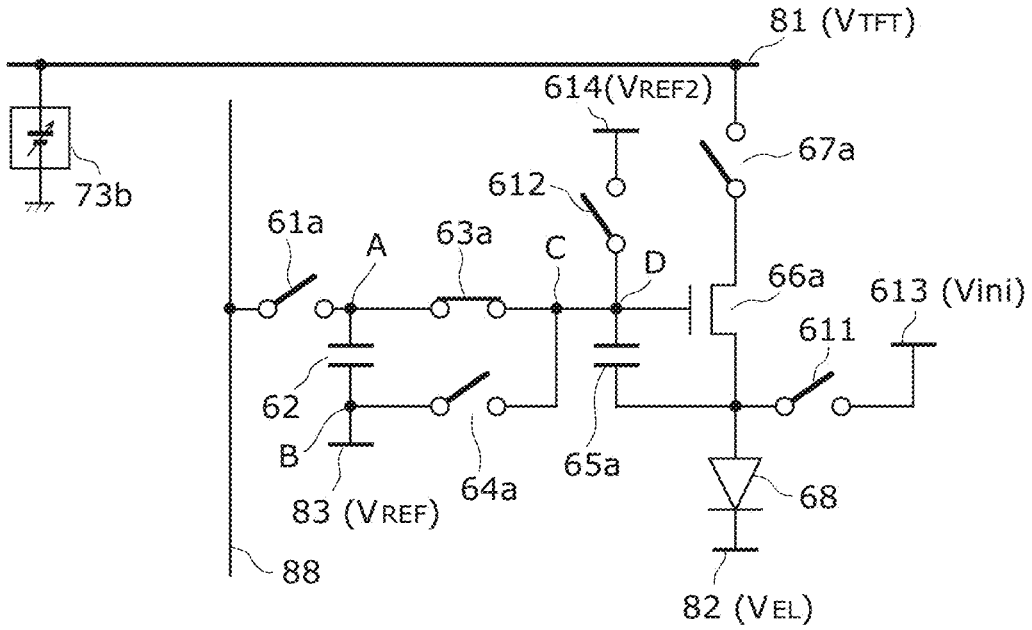
FIG. 12G is a diagram illustrating an example of the operation of the pixel circuit illustrated in FIG. 10.

FIG. 12G illustrates the operation scene of the voltage adjustment process of adjusting the predetermined voltage (anode voltage) by the adjustment unit 7. The voltage adjustment process is a process of adjusting the anode voltage of the EL anode power line 81 (the voltage $V_{TFT}$ of the voltage source 73*b*) in the non-light emission period, as illustrated in FIG. 12G.

Although FIG. 12G illustrates the scene where the voltage adjustment process is performed concurrently with the copy process illustrated in FIG. 12F, this is not a limitation. The voltage adjustment process may be performed at any timing in the non-light emission period during which the switch 67*a* is nonconducting (off).

The adjustment unit 7 calculates the current flowing in the organic EL display panel 6, from the display data signal S1 of one frame or subfield. Based on the calculation result, the adjustment unit 7 changes (adjusts) the anode voltage to be lower than the predetermined voltage. This enables overload control so that the panel power due to the current flowing into the organic EL display panel 6 is less than a predetermined level. The adjustment unit 7, in combination with the pixel circuit 60A in this embodiment, can perform the cathode voltage change as overload control in the non-light emission period before video display, without lowering video quality.

For example, the reset process, the copy process, and the voltage adjustment process are performed in the blanking period. During these operations, the shift operation of the gate driver circuit is stopped. Moreover, these operations are performed simultaneously on all pixels of the display screen.

(Light Emission Process)

Figure 12H:
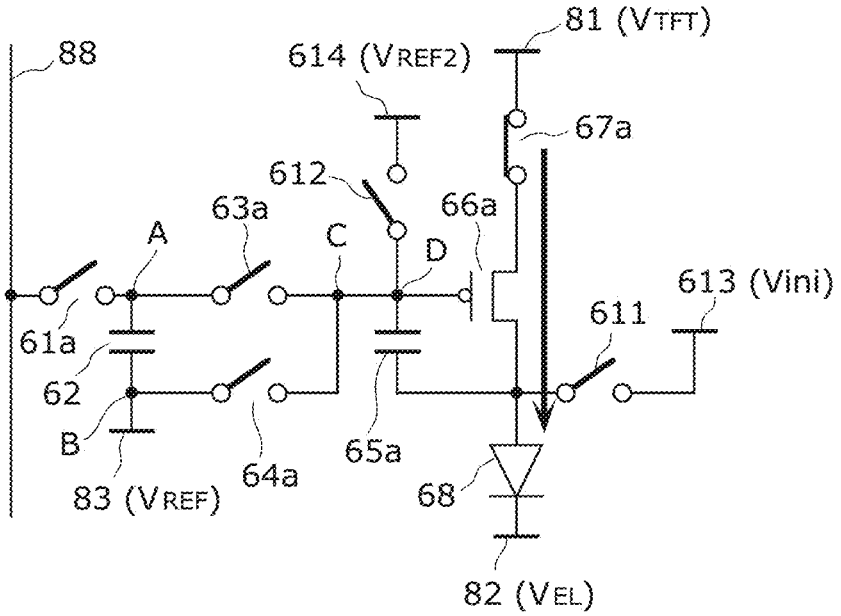
FIG. 12H is a diagram illustrating an example of the operation of the pixel circuit illustrated in FIG. 10.

FIG. 12H illustrates the operation scene of the light emission process where the organic EL element 68 emits light.

In this embodiment, only the switch 67*a* is rendered conducting (on). This enables the organic EL element 68 to emit light according to the next video signal voltage (Vsig) held in the capacitance element 65*a*.

By repeatedly executing the write process, the reset process, the copy process, the voltage adjustment process, and the light emission process in the aforementioned manner, video (e.g. a moving image) can be displayed on the plurality of display pixels in this embodiment.

In the light emission process, by changing the switch 67*a* from nonconduction (off) to conduction (on) simultaneously in all display pixels of the organic EL display panel 6, the frame display can be switched simultaneously in all display pixels. Thus, the display according to the current video signal voltage and the display according to the next video signal voltage can be kept from being mixed.

2-4. Advantageous Effects

As described above, the organic EL display device 1 according to this embodiment can prevent a decrease in life of the organic EL elements 68.

In detail, the organic EL display device 1 according to this embodiment includes the adjustment unit 7, and is capable of writing a data signal voltage and displaying video independently of each other. This enables overload control so that the panel power due to the current flowing into the organic EL panel is less than a predetermined level, without lowering video quality. A decrease in life of the organic EL elements 68 can thus be prevented.

The adjustment unit 7 calculates the current flowing in the organic EL display panel 6, from the display data signal S1 of one frame or subfield. Based on the calculation result, the adjustment unit 7 changes the cathode voltage to be lower than the predetermined voltage. This enables overload control so that the panel power due to the current flowing into the organic EL display panel 6 is less than a predetermined level. Moreover, the adjustment unit 7 can perform the anode voltage change as overload control in the non-light emission period before video display. This has the advantageous effect of preventing lower video quality.

Furthermore, since the organic EL display device 1 according to this embodiment can perform overload control, no heat dissipation mechanism to cool the organic EL display panel 6 is needed. This has the advantageous effect of realizing a thinner organic EL display panel 6.

[Variations]

Although Embodiments 1 and 2 describe the case where the organic EL display device 1 expresses a video signal as one frame in one frame period, this is not a limitation. The organic EL display device 1 may express a video signal using a plurality of subfields obtained by dividing one frame period into a plurality of subfield periods (subframe periods). In other words, the period between the light emission period (first light emission period) during which the organic EL element 68 emits light and the next light emission period (second light emission period) during which the organic EL element 68 emits light may be one frame period or a subfield period (frame period).

Figure 13:
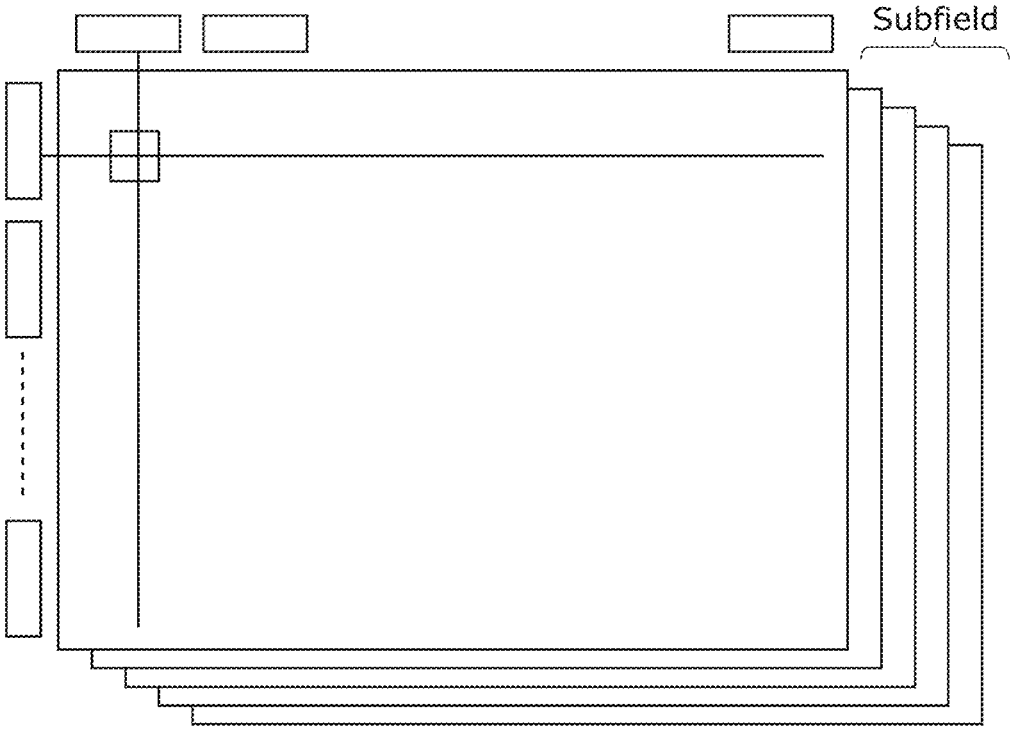
FIG. 13 is a diagram conceptually illustrating the case where one frame is composed of a plurality of subfields according to Variation 1.

FIG. 13 is a diagram conceptually illustrating the case where one frame is composed of a plurality of subfields according to Variation 1. In this variation, one frame may be expressed by superimposing a plurality of subfields (subframes). By lighting the whole display pixels according to, for example, the luminance in each subframe period in one frame period, the luminance in each subfield period is superimposed together, with it being possible to obtain desired luminance in one frame period. The whole display pixels need not necessarily be lit according to the luminance in each subfield period. The total luminance in one frame period may be evenly distributed to the subfield periods, or the high to low bits of the total luminance in one frame period may be distributed as in field driving in a plasma display panel (PDP). The method of distribution is not limited as long as superimposing the luminance values of the subfield periods yields the total luminance in one frame period.

For example, a video signal of one frame is divided into a plurality of subfields, and each subfield is classified by luminance (brightness). Each subfield may be classified by, for example, the bit position of video data. For example, in the case where the video signal is 8 bits, 8 subfields constitute one frame. The source driver IC outputs the voltage value obtained by weighting the bit to the source signal line in each subfield. In this case, the index value of each pixel row can be obtained by calculating the number of bits "1".

Figure 14:
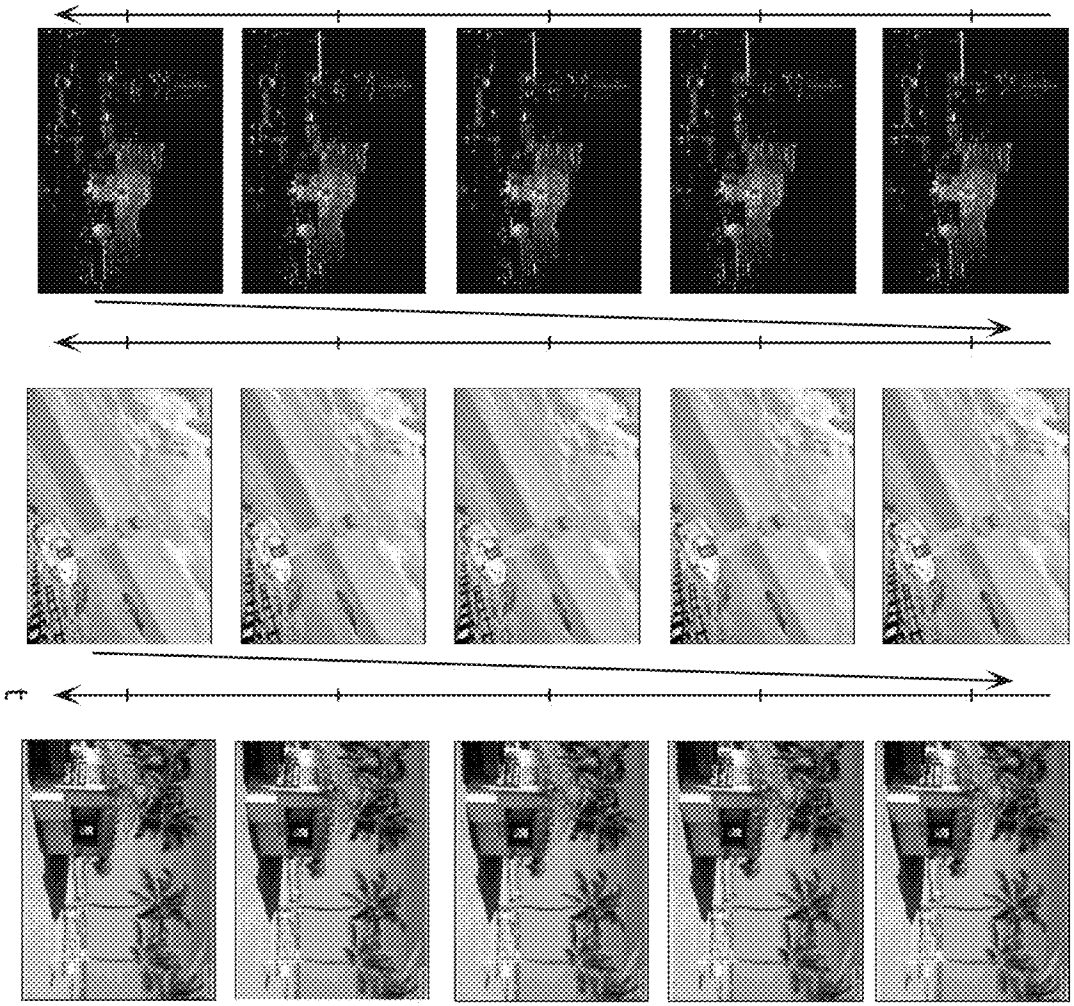
FIG. 14 is a diagram illustrating an example of a frame composed of a plurality of subfields according to Variation 1.

FIG. 14 is a diagram illustrating an example of a frame composed of a plurality of subfields according to Variation 1. FIG. 14 illustrates a display screen of each subfield, using an example where 5 subfields constitute a frame.

In detail, the organic EL display device according to the present disclosure includes the pixel circuit 60 in FIG. 3 or the pixel circuit 60A in FIG. 10, and so is capable of writing a luminance signal and displaying video independently of each other. Accordingly, in the case of displaying video in each subfield, the video can be displayed without the video of two subfields being mixed on one screen. In other words, since the next video signal voltage can be written and held during the display of the current subfield on one screen, the screen can be switched in one operation when displaying the next video.

This prevents lower video quality caused by mixed display of two subfields as in conventional cases. Not only video quality can be improved, but also the amount of heat generation of the organic EL display panel 6 in the organic EL display device 1 can be reduced.

[Variation 2]

Figure 15:
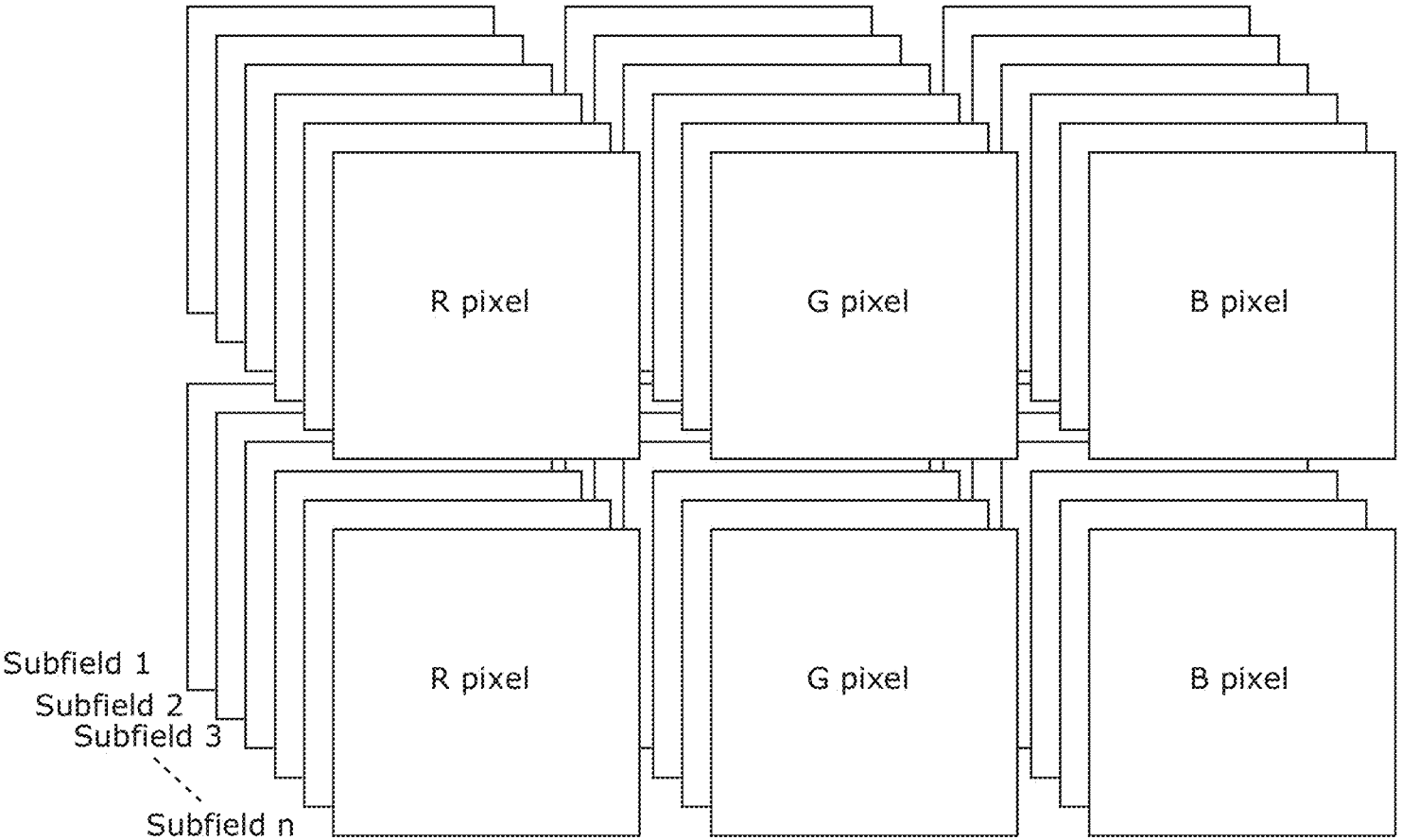
FIG. 15 is a diagram illustrating an example of a frame composed of a plurality of subfields according to Variation 2.

While Variation 1 describes the case where one frame is composed of a plurality of subframes, this is not a limitation. The gray level (luminance) of each pixel may be expressed by being divided into a plurality of subfields (subframes), as illustrated in FIG. 15.

Other Embodiments

While the organic EL display device has been described above by way of embodiments, the present disclosure is not limited to these embodiments. Other modifications obtained by applying various changes conceivable by a person skilled in the art to the embodiments and any combinations of the structural elements in different embodiments without departing from the scope of the present disclosure are also included in the scope of one or more aspects.

INDUSTRIAL APPLICABILITY

Figure 16:
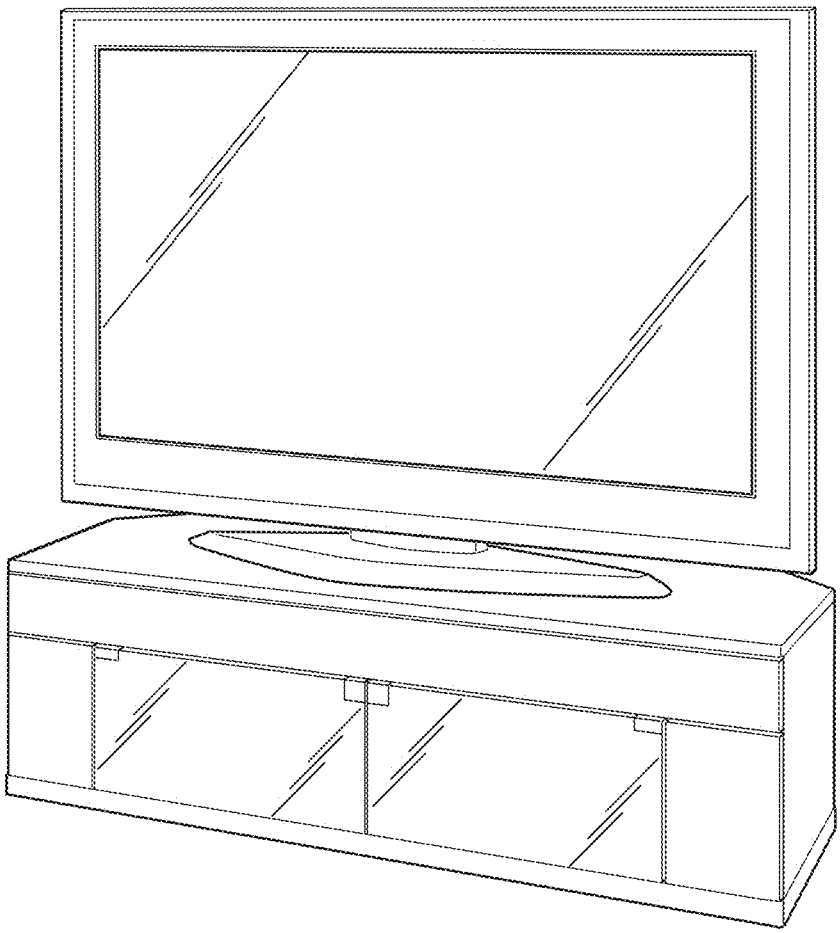
FIG. 16 is an appearance view of a thin flat television including an organic EL display device according to the present disclosure.

The present invention can be used for an organic EL display device and a method of driving the organic EL display device, and particularly for a FPD display device such as a television illustrated in FIG. 16.

REFERENCE SIGNS LIST

1 organic EL display device
2 display panel control circuit
3, 30, 31 gate driver IC (circuit)
5 source driver IC (circuit)
6 organic EL display panel
7 adjustment unit
60, 60A, 60*a*, 60*b* pixel circuit
61, 61*a*, 63, 63*a*, 64, 64*a*, 67, 67*a*, 611, 612 switch
62, 65, 65*a* capacitance element
66, 66*a* drive transistor
68 organic EL element
71 current calculation unit
72 voltage calculation unit
73 voltage change unit
73*a*, 73*b* voltage source
81 EL anode power line
82 EL cathode power line
83, 614 reference power line
84, 84*a*, 85, 85*a*, 86, 86*a*, 87, 87*a* gate signal line
88 source signal line
613 initialization power line
616 control line
617 Init line
711 first current value calculation unit
712 second current value calculation unit
713 third current value calculation unit
714, 715, 716 weighting unit
717 addition unit

The invention claimed is:

1. An organic EL display device comprising:

a plurality of display pixels arranged in a matrix; and an adjustment unit configured to adjust a predetermined voltage applied to a power line connected to the plurality of display pixels, wherein each of the plurality of display pixels includes:

a light emitting element;

a first capacitance element that holds a first voltage used to cause the light emitting element to emit light;

a drive transistor that causes the light emitting element to emit light, by supplying a current corresponding to the first voltage held in the first capacitance element to the light emitting element; and a second capacitance element that holds a second voltage different from the first voltage held in the first capacitance element, the second voltage being a next voltage to be held in the first capacitance element, the power line is connected to a drain electrode of the drive transistor or a cathode of the light emitting element, and the adjustment unit is configured to adjust the voltage applied to the power line to be lower than the predetermined voltage, when a total sum of current of the plurality of display pixels in the case where a current corresponding to the second voltage is supplied to the light emitting element in each of the plurality of display pixels is greater than or equal to a threshold.

2. The organic EL display device according to claim 1, further comprising a control unit configured to control each of the plurality of display pixels, wherein the control unit is configured to, in each of the plurality of display pixels:

cause the second capacitance element to hold the second voltage, in a first period in a light emission period during which the light emitting element emits light; and copy the second voltage held in the second capacitance element to the first capacitance element to cause the first capacitance element to hold the second voltage as the first voltage, in a second period following an initialization period in a non-light emission period after the light emission period, the initialization period being a period during which the first capacitance element is initialized, and the adjustment unit is configured to adjust the voltage applied to the power line to be lower than the predetermined voltage in the non-light emission period, when the total sum of current of the plurality of display pixels corresponding to the second voltage is greater than or equal to the threshold.

3. The organic EL display device according to claim 1, displaying video by dividing one frame period of a video signal into a plurality of subframe periods, wherein a period between a light emission period during which the light emitting element emits light and a next light emitting period during which the light emitting element emits light corresponds to any of the plurality of subframe periods.

4. The organic EL display device according to claim 1, wherein the adjustment unit is configured to adjust the voltage applied to the power line to be lower than the predetermined voltage by linearly changing the voltage for a predetermined time, when the total sum of current of the plurality of display pixels corresponding to the second voltage in the case where the current corresponding to the second voltage is supplied to the light emitting element in each of the plurality of display pixels is greater than or equal to the threshold.

5. The organic EL display device according to claim 1, wherein in the case where the drive transistor is p-type, the drive transistor has the drain electrode connected to a first electrode of the first capacitance element, a gate electrode connected to a second electrode of the first capacitance element, and a source electrode connected to an anode of the light emitting element, and the power line is connected to the cathode of the light emitting element.

6. The organic EL display device according to claim 5, wherein each of the plurality of display pixels further includes:

a first switch that switches between conduction and non-conduction between a signal line for supplying a data signal voltage and a first electrode of the second capacitance element;

a second switch that switches between conduction and nonconduction between the first electrode of the second capacitance element and the second electrode of the first capacitance element;

a third switch that switches between conduction and nonconduction between a reference power line for supplying a reference voltage and the second electrode of the first capacitance element; and a fourth switch that switches between conduction and nonconduction between the source electrode of the drive transistor and the anode of the light emitting element, the reference power line is connected to a second electrode of the second capacitance element, and the first switch, the second switch, the third switch, and the fourth switch are each a p-type transistor.

7. The organic EL display device according to claim 1, wherein in the case where the drive transistor is n-type, the power line is connected to the drain electrode of the drive transistor, and the drive transistor has a source electrode connected to a first electrode of the first capacitance element and an anode of the light emitting element, and a gate electrode connected to a second electrode of the first capacitance element.

8. The organic EL display device according to claim 7, wherein each of the plurality of display pixels further includes:

a first switch that switches between conduction and non-conduction between a signal line for supplying a data signal voltage and a first electrode of the second capacitance element;

a second switch that switches between conduction and nonconduction between the first electrode of the second capacitance element and the second electrode of the first capacitance element;

a third switch that switches between conduction and nonconduction between a reference power line for supplying a reference voltage and the second electrode of the first capacitance element; and a fourth switch that switches between conduction and nonconduction between the drain electrode of the drive transistor and the power line, the reference power line is connected to a second electrode of the second capacitance element, and the first switch, the second switch, the third switch, and the fourth switch are each an n-type transistor.

9. A method of driving an organic EL display device including: a plurality of display pixels arranged in a matrix; and a power line that is connected to the plurality of display elements and to which a predetermined voltage is applied, each of the plurality of display pixels including: a light emitting element; a first capacitance element that holds a first voltage used to cause the light emitting element to emit light; a drive transistor that causes the light emitting element to emit light, by supplying a current corresponding to the first voltage held in the first capacitance element to the light emitting element; and a second capacitance element that holds a second voltage different from the first voltage held in the first capacitance element, the second voltage being a next voltage to be held in the first capacitance element, the power line being connected to a drain electrode of the drive transistor or a cathode of the light emitting element, and the method comprising:

adjusting the voltage applied to the power line to be lower than the predetermined voltage, when a total sum of current of the plurality of display pixels in the case where a current corresponding to the second voltage is supplied to the light emitting element in each of the plurality of display pixels is greater than or equal to a threshold; and causing the drive transistor to supply the current corresponding to the second voltage held in the first capacitance element to the light emitting element.

* * * * *